US007717645B2

(12) United States Patent
McLaughlin

(10) Patent No.: US 7,717,645 B2
(45) Date of Patent: May 18, 2010

(54) ADJUSTABLE PHYSICAL STRUCTURES FOR PRODUCING HYDRAULIC FORMATIONS FOR WHITEWATER RECREATIONALISTS

(75) Inventor: Richard Evan McLaughlin, Lakewood, CO (US)

(73) Assignee: McLaughlin Consulting Company, Denver, CO (US)

( * ) Notice: Subject to any disclaimer, the term of this patent is extended or adjusted under 35 U.S.C. 154(b) by 263 days.

(21) Appl. No.: 11/925,144

(22) Filed: Oct. 26, 2007

(65) Prior Publication Data

US 2008/0101866 A1 May 1, 2008

Related U.S. Application Data

(60) Provisional application No. 60/854,747, filed on Oct. 27, 2006.

(51) Int. Cl.
*E02B 3/00* (2006.01)

(52) U.S. Cl. ..... 405/79; 472/128

(58) Field of Classification Search ..... 405/79, 405/80; 472/117, 128
See application file for complete search history.

(56) References Cited

U.S. PATENT DOCUMENTS

| | | | | |
|---|---|---|---|---|
| 2,605,616 | A * | 8/1952 | Danel | 405/118 |
| 3,802,697 | A * | 4/1974 | Le Mehaute | 405/79 |
| 5,401,117 | A | 3/1995 | Lochtefeld | |
| 5,421,782 | A * | 6/1995 | Lochtefeld | 472/128 |
| 5,453,054 | A * | 9/1995 | Langford | 405/79 |
| 5,628,584 | A | 5/1997 | Lochtefeld | |
| 5,667,445 | A * | 9/1997 | Lochtefeld | 472/117 |
| 5,899,633 | A | 5/1999 | Lochtefeld | |
| 6,019,547 | A | 2/2000 | Hill | |
| 6,319,137 | B1 | 11/2001 | Lochtefeld | |
| 6,454,659 | B1 | 9/2002 | Noble | |
| 6,629,803 | B1 | 10/2003 | McFarland | |
| 6,716,107 | B2 | 4/2004 | Lochtefeld | |
| 6,932,541 | B2 | 8/2005 | McFarland | |
| 7,114,879 | B2 | 10/2006 | Obermeyer | |

(Continued)

OTHER PUBLICATIONS

Moore, W. L. and Morgan, C. W. "The Hydraulic Jump at an Abrupt Drop", Journal of the Hydraulics Division, Proceedings of the ASCE, Paper 1449, vol. 83, No. HY 6, Dec. 1957, pp. 1449-1 thru 1449-21.

(Continued)

*Primary Examiner*—Frederick L Lagman
(74) *Attorney, Agent, or Firm*—Stephen A. Gratton

(57) ABSTRACT

An adjustable physical structure for producing hydraulic formations for whitewater recreationalists includes a control structure, and an adjustable lip located downstream of the control structure. The control structure can include a crest and a ramp. The crest constricts and/or elevates (dams) the flow water to increase it's energy and focus the flow of water. Downstream of the crest, the ramp routes the flow of the water to the adjustable lip. The ramp can have varying and non-linear slopes and plan configurations. Additionally, the ramp can be static or adjustable to elevate the flow of water and vary the velocity and energy of the supercritical flow as it is passed to the adjustable lip. An adjustable invert physical structure comprises a shaped structure configured for placement on the invert of the channel. The adjustable invert physical structure can be moved or adjusted in horizontal and/or vertical directions to shape the flow of water.

26 Claims, 15 Drawing Sheets

U.S. PATENT DOCUMENTS

| | | | | |
|---|---|---|---|---|
| 2002/0082097 | A1* | 6/2002 | Henry et al. | 472/117 |
| 2003/0198515 | A1* | 10/2003 | McFarland | 405/79 |
| 2005/0090321 | A1* | 4/2005 | Henry et al. | 472/117 |
| 2005/0207845 | A1* | 9/2005 | McFarland | 405/79 |
| 2006/0026746 | A1* | 2/2006 | McFarland | 405/79 |
| 2006/0052171 | A1* | 3/2006 | Henry et al. | 472/117 |
| 2006/0178222 | A1* | 8/2006 | Henry et al. | 472/117 |

OTHER PUBLICATIONS

Hsu, En-Yun, Hsu on Hydraulic Jump, "Discussion" ASCE, vol. 115, pp. 988-991, Dec. 1957.

Mohammed A. Samad et al., "Modeling of the Undular Jump for Whitewater Bypass", McLaughlin Water Engineers, Ltd., 2420 Alcott Street, Denver, CO, Proceedings of the 1986 National Conference, ASCE, 1986, pp. 1-9.

* cited by examiner

Lowered Position

Raised Position 12C
64C
12A, 12B, 12D OR 12H
18
88C
4B
28C
4A
4A
60C
62C
22C
18
28C
20C
4B
16

12C
62C
30C
12A, 12B, 12D
12F OR 12H
28C
48C
64C 48C
26C
46C
64C
28C
70C
62C
12C
60C
30C
18
22C
20C
16

48E
34E
28E
72E
30E
12A OR 12B OR 12H 5B
18
12A OR 12B OR 12H
34E
5A
5A
12E
18
5B 48E
88E
46E
26E
28E
70E
34E
12E
18
22E
30E
20E

ADJUSTABLE PHYSICAL STRUCTURES FOR PRODUCING HYDRAULIC FORMATIONS FOR WHITEWATER RECREATIONALISTS

CROSS REFERENCE TO RELATED APPLICATION

This application claims priority from U.S. provisional application Ser. No. 60/854,747 filed Oct. 27, 2006.

BACKGROUND

Whitewater recreationalists are persons in or on a river, rapid, or flowing channel that use the currents and various hydraulic formations for recreation and enjoyment. This grouping of recreationalists is also referred to as "boaters" or "river runners". There are many different types of whitewater craft that whitewater recreationalists can use to make their way down a river or rapid. An abbreviated list includes:

| Rafts | Kayaks | Inflateable kayaks and other craft | Open-decked Canoes |
|---|---|---|---|
| Closed-decked Canoes | Dory or Drift Boats | Personal Inflated Water Craft ("rubber duckies") | Catarafts |
| Wake boards & other small boards used to assist swimming | Swimmers with or without fins, and paddles | Surfboards & Riverboards | Tubes |

Whitewater recreationalists include an increasing number of persons with disabilities including paraplegics, the blind, amputees, etc. Organized sports which involve or evolved from recreational whitewater include:

- Slalom: A competitive event for canoeing and kayaking where boaters negotiate gates suspended over the river for the fastest time.
- Freestyle or Rodeo: A competitive event for canoeing and kayaking where boaters perform tricks on a wave, hole, or other hydraulic feature or obstruction.
- Rafting: An event where rafters race down the river for the fastest time.
- Down-River or Wildwater kayaking: An event where kayakers race down the river for the fastest time.
- Squirt Boating: A competitive event where kayakers and canoeists perform tricks utilizing sub-surface current in low volume boats.

Open Channel Hydraulics is the formalized science that considers the formation of hydraulic formations that are encountered by whitewater recreationalists found in rivers and man-made structures. This includes those features associated with whitewater rapids and features. The basic equations governing whitewater hydraulic formations are the Navier-Stokes equations which are an application of Newton's second law. These can be reduced to simpler forms when considering the free (water) surface found in rivers and channels and the incompressibility of water.

Whitewater recreationalists refer to various hydraulic formations found in fast-moving rivers, rapids, and channels. These hydraulic formations include "Holes", "Waves", and "Hydraulics". These describe various forms of what is referred to by scientists and engineers as a hydraulic jump. (Note however that waves can be formed by other hydraulic mechanisms.) A hydraulic jump occurs when fast moving flow in a state known as supercritical changes to a slower moving subcritical state. From a scientific point of view, supercritical flow is defined as having a Froude Number greater than one, and subcritical flow is defined as having a Froude Number less than one. The Froude Number is a well defined hydraulic term which is a dimensionless ratio of inertial forces to gravitational forces. The Froude Number is defined as $V_\sqrt{(gd)}$, where V=velocity of the flow, g=gravitational acceleration, and d=characteristic depth.

The hydraulic jump was studied extensively in the 1950s and 1960s, although hydraulic jump formations involving non-linear channel geometries formations can be quite complex and difficult to analyze or predict—even with computer modeling. Physical structures that can create waves and holes with recreationally desirable attributes have a vertical or steep downward slope in the vicinity where the hydraulic jump occurs. This condition was studied in the 1950s and 1960s and is know as a hydraulic jump at an abrupt drop.

The abrupt drop can cause the hydraulic jump to stabilize in deeper areas, and create other characteristics that are advantageous to whitewater recreationalists. At an abrupt drop the transition from supercritical to subcritical flow is characterized by several flow patterns depending upon the inflow and conditions found in the downstream pool (tailwater). These flow patterns include (1) the A-jump, (2) the wave jump or W-jump or the wave train, and (3) the B-jump which is characterized by a plunging jet. The characteristics of wave jump and wave train are essentially the same and hereafter the wave jump and wave train will simply be referred to as 'Wave'

Holes and waves are often the predominant features treasured by whitewater recreationalists. Holes are more retentive—having tendency to impede the passage of buoyant objects, while waves create exciting changes in elevation. Waves known as "breaking waves" can also have breaking water (whitewater) toward their crest that acts to retain buoyant whitewater craft. The form and type of these hydraulic jumps varies dramatically and even small nuances not noticeable to the untrained eye can affect the desirability to whitewater recreationalists.

Pools are areas in a river or channel that move slowly (relative to the higher velocity rapids) in the downstream direction. They are typically in a hydraulic state known as subcritical—having a Froude Number less than a value of one. However higher velocity currents or jets can carry through the entire length of a pool. Pools can also have recirculating eddy currents known as "eddies". Pools are advantageous to whitewater recreationalists for recovery.

Eddies are formed upstream and downstream of obstructions in a river. Eddies are generally recognized by whitewater recreationalists to occur in a pool adjacent to and downstream of a wave or hole. Eddies are currents that tend to rotate in the horizontal plane. This rotation can usually be seen on the surface of the water. Typically, the flow in an eddy is oriented upstream rather than downstream. An eddy can have slow or mild upstream currents or can be quite violent. The characteristics of an eddy are important to the recreational experience of whitewater recreationalists playing in an adjacent hydraulic jump.

Structures that create the various formations of the hydraulic jump including waves and holes tend to control and focus flow and/or lower the flow to increase it's velocity and power so that it is supercritical. This requires some type of crest, which usually has elevated portions to form a constriction. The flow in the vicinity of the physical crest—also known as a control section—typically enters a state known as critical depth. Note that at this location, the Froude Number of the flow has a value of one. Downstream of this crest is a ramp where the flow transitions from a critical state to supercritical state prior to entering the hydraulic jump. Note that some structures have an entirely vertical ramp; while in others; there is no clear physical distinction between the crest and the ramp. The ramp is simply where the flow transitions from the critical flow to the hydraulic jump.

A wave can also be created in situations where a hydraulic jump is not involved. Sometimes known as a wave train or standing waves, these can be created by a perturbation or series of perturbations or "bumps" in the invert of a river or channel. This type of wave, however, is difficult to reliably create or predict and usually occurs through very specific flow rates when found in natural rivers.

Typically, prior art man made physical structures for producing hydraulic formations have fixed geometries and fixed dimensions. One problem with these fixed physical structures is that they may not produce the desired hydraulic formations at normal or low water flow rates. In addition, at excessively high water flow rates, fixed physical structures may form constrictions, increased floodplains and high water surface elevations.

It would be advantageous for physical structures for producing hydraulic formations to have an adjustable geometry, which could be used to vary the size and character of the corresponding hydraulic formations over a wide range of water flow rates. It would also be advantageous for physical structures for producing hydraulic formations to be adjustable for constructing a variety of systems for whitewater recreationalists under a variety of conditions.

Various embodiments of adjustable physical structures to be further described can be used to form hydraulic formations. In addition, the adjustable physical structures can be adjusted to vary the geometry of the hydraulic formations, and can be used over a wide range of flow rates and environmental conditions. Further, the adjustable physical structures can be used to construct various systems including kayak courses, rafting courses, boating courses and theme park rides.

However, the foregoing examples of the related art and limitations related therewith, are intended to be illustrative and not exclusive. Other limitations of the related art will become apparent to those of skill in the art upon a reading of the specification and a study of the drawings.

SUMMARY

An adjustable physical structure is configured for placement in a channel containing a flow of water for producing a variety of hydraulic formations beneficial for whitewater recreationalists. The channel can comprise a man made channel, or a natural channel such as a river bed. The adjustable physical structure includes a control structure placed in the channel, and an adjustable lip located downstream of the control structure.

The control structure can include a crest and a ramp downstream of the crest. The crest constricts and/or elevates (dams) the flow water to increase it's energy and focus the flow of water. The crest can be curved, linear or irregular in both plan and in cross-section. The flow in the vicinity of the crest—also known as a control section—goes through a state known as critical depth. At this location, the Froude Number of the flow of water has a value of one. If present, the ramp routes the flow of the water to the adjustable lip. The ramp can have varying and non-linear slopes and plan configurations. Additionally, the ramp can be static or adjustable to elevate the flow of water and vary the velocity and energy of the supercritical flow as it is passed to the adjustable lip.

The adjustable lip is configured for placement at a selected position in the flow of water. For example, the adjustable lip can be adjusted vertically to vary the elevation and angle of supercritical flow as it exits the adjustable physical structure and enters a downstream pool where the flow transitions—via a hydraulic jump to subcritical flow. The adjustable lip can also be located downstream of a second adjustable plate(s), perforated plate(s), or series of vanes. The adjustable physical structure can also include an adjustable placement mechanism such as a cylinder, a bladder or a mechanical jack, which can be operated to place the adjustable lip in the selected position.

An alternate embodiment adjustable invert physical structure comprises a shaped structure configured for placement on the invert of the channel. The adjustable invert physical structure can be moved or adjusted in horizontal and/or vertical directions to shape the flow of water.

A method for forming hydraulic formations includes the steps of providing a flow of water in a channel; providing an adjustable lip configured for placement in a selected position in the flow of water; forming a drop upstream of the adjustable lip; accelerating the flow of water towards the lip; and adjusting a position of the lip in the flow of water to the selected position.

A whitewater system includes one or more adjustable physical structures and/or adjustable invert physical structures placed in a channel at desired locations, and configured to form desired hydraulic formations.

BRIEF DESCRIPTION OF THE DRAWINGS

Exemplary embodiments are illustrated in the referenced figures of the drawings. It is intended that the embodiments and the figures disclosed herein are to be considered illustrative rather than limiting.

DETAILED DESCRIPTION

Figure 1A:
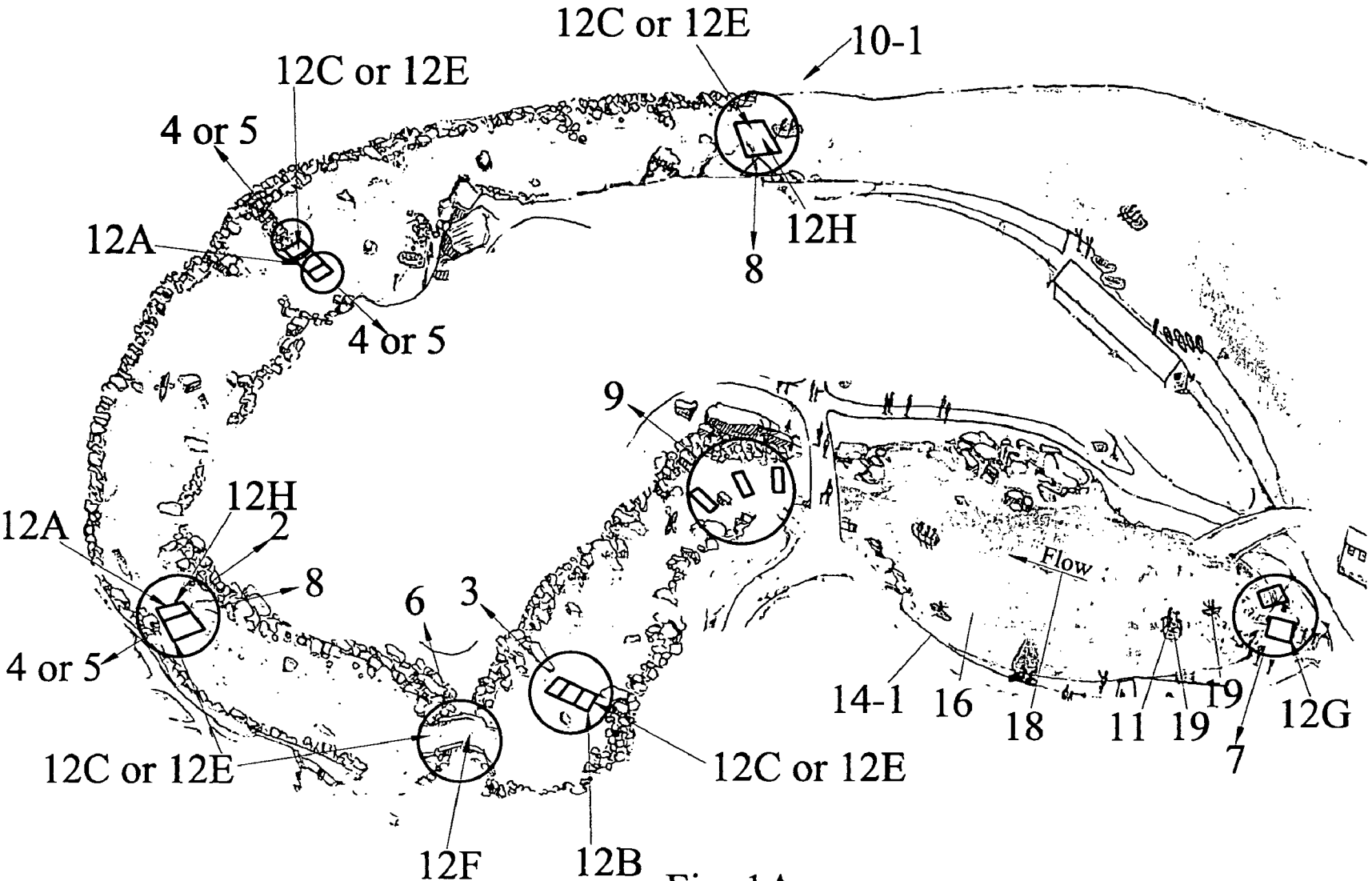
FIG. 1A is a schematic plan view of a system for whitewater recreationalists constructed using adjustable physical structures for producing hydraulic formations.

Referring to FIG. 1A, a whitewater system 10-1 includes various adjustable physical structures 12A-12H which produce various hydraulic formations. By way of example, the whitewater system 10-1 can be part of a theme park or other attraction for whitewater recreationalists 11. The whitewater system 10-1 (FIG. 1A) includes a man made channel 14-1 configured to contain a flow of water 16 in a closed loop as indicated by water flow direction 18. The whitewater system 10-1 (FIG. 1A) is sized to allow one or more watercraft 19, and swimmers as well, to ride on the flow of water 16 through the system 10-1. The whitewater system 10-1 (FIG. 1A) can also include one or more pumps (not shown) configured to produce the flow of water 16. A representative depth d of the flow of water 16 in the channel 14-1 can be from 4 inches to 10 feet. A representative flow rate of the flow of water 16 in the channel 14-1 can be from about 30 cubic feet per second (cfs) to 1000 cubic feet per minute (cfs).

Figure 1B:
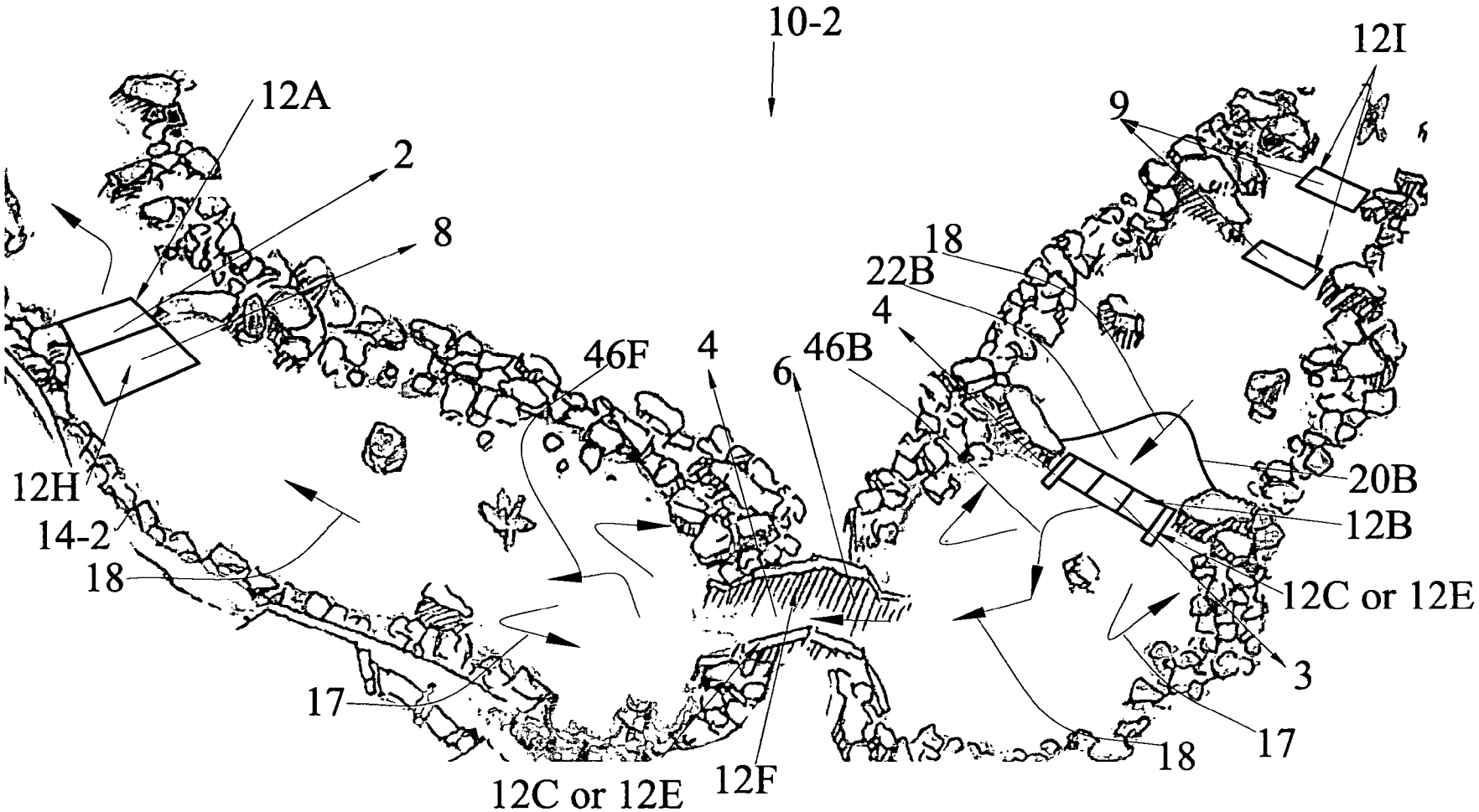
FIG. 1B is a schematic plan view of another system for whitewater recreationalists constructed using adjustable physical structures for producing hydraulic formations.

Referring to FIG. 1B, a whitewater system 10-2 containing adjustable physical structures 12A-12H is illustrated. In this embodiment, the channel 14-2 can comprise a river bed, and the system 10-2 can form a whitewater course such as a slalom course, a kayak course, a rafting course or a boating course.

Figure 2:
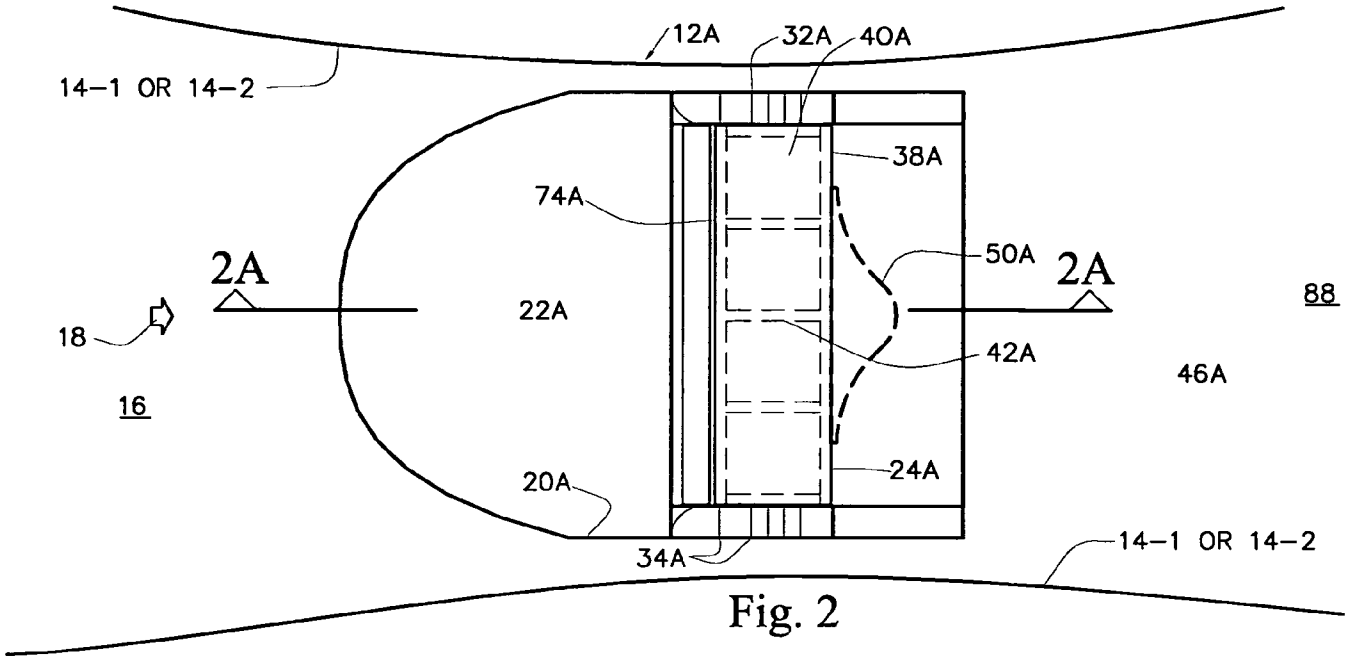
FIG. 2 is a plan view of an adjustable physical structure for producing hydraulic formations taken along line 2 of FIGS. 1A and 1B.
Figure 2A:
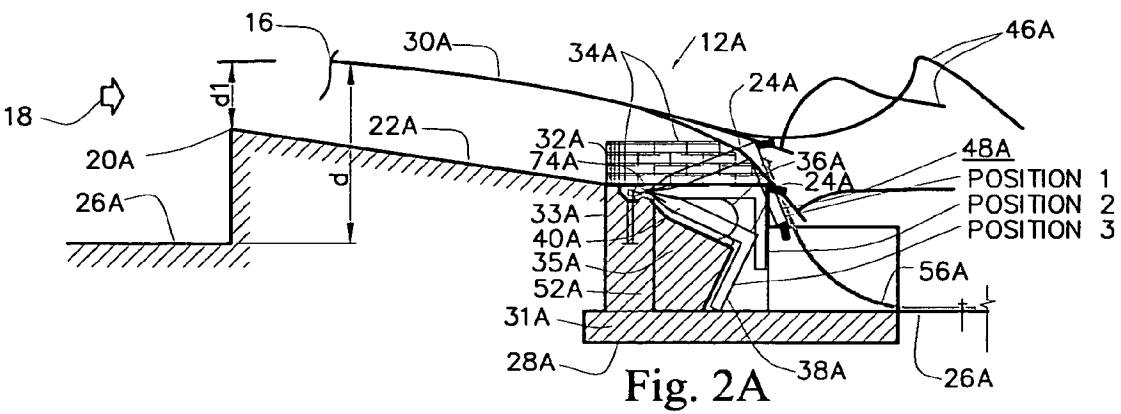
FIG. 2A is a cross sectional view taken along section line 2A-2A of FIG. 2.

Referring to FIGS. 2 and 2A, an adjustable lip physical structure 12A is illustrated. The adjustable lip physical structure 12A (FIGS. 2-2A) includes a crest 20A, a ramp 22A and an adjustable lip 24A. The crest 20A and the ramp 22A form a control section in which the flow of water 16 is focused and increased in energy. The crest 20 (FIGS. 2-2A) is formed or placed on the invert 26A (bottom) of the channel 14-1 or 14-2 oriented generally vertically, and generally perpendicular to the water flow direction 18. The crest 20A (FIGS. 2-2A), and the ramp 22A as well, can be formed of a solid material such as concrete, rock, grouted rock or steel. The crest 20A (FIGS. 2-2A) functions similarly to a dam, and is configured to focus and build up the water to form a hydraulic drop. The hydraulic drop is the difference in elevation between the water surface upstream and the water surface downstream of the adjustable lip physical structure 12A. The height of the crest 20A (FIGS. 2-2A) will be dependent on the depth d of the water in the channel 14 and the desired power, hydraulic formation, and recreational experience created by the physical structure. A representative depth dl (FIG. 2) of the flow of water 16 above the top of the crest 20A can be from 0.5 feet to 6 feet. A representative width of the crest 20A, and the ramp 22A and adjustable lip 24A as well, can be from 6 feet to 30 feet.

The ramp 22A (FIGS. 2-2A) comprises a sloped structure that can be formed continuously with the crest 20A. The ramp 22A (FIGS. 2-2A) is configured to accelerate the flow of water 16 from the crest 20A downstream to the adjustable lip 24A. The ramp also varies the velocity and energy of the flow of water 16 which preferably has a supercritical flow as it contacts the adjustable lip 24A. As shown in FIG. 2A, the ramp 22A (FIGS. 2-2A) can slope downwardly from the upstream end to the downstream end of the adjustable lip physical structure 12A. A representative slope of the ramp 22A (FIGS. 2-2A) can be from 0.5 inches per foot to 12 inches per foot. The ramp 22A can also have a shape which converges the flow of water 16 towards the adjustable lip 24A, such that a more focused v-shaped hydraulic formation is produced. The ramp 22A can also have a shape which diverges the flow of water 16 towards the adjustable lip 24A such that a broader hydraulic formation is produced.

The adjustable lip 24A (FIGS. 2-2A) comprises a generally l-shaped structure pivotably and adjustably mounted to a base 28A (FIG. 2A). The adjustable lip 24A is located on a stepped invert 26A of the channel 14-1 (FIG. 1A), 14-2 (FIG. 1B) having a vertical drop 52A. The adjustable lip 24A can be formed of a material such as steel, and can be weighted with a material such as concrete, to resist the large hydraulic forces encountered during operation of the adjustable lip physical structure 12A. As shown in FIG. 2A, the adjustable lip 24A can include a vertical member 38A and a horizontal member 40A, which can be welded or bolted together. The inside angle between the horizontal member and the vertical member can range from 90 degrees (as shown) to 160 degrees. As shown in FIG. 2, the adjustable lip 24A can also include bracing members 42A, and a pivot support member 44A which pivotably mounts the adjustable lip 24A to the base 28A on bolts, pins or other mechanisms.

In FIG. 2A, the adjustable lip 24A is shown in three different positions (Positions 1-3) in the flow of water 16. The adjustable lip 24A can be locked in each of these positions (Positions 1-3) as well as any position in between. As also shown in FIG. 2A, the position of the adjustable lip 24A can be selected as required, from a lowered position (Position 1) wherein it is located beneath the surface of the ramp 22A, to a generally horizontal medial position (Position 2) wherein it is generally planar with the surface of the ramp 22A, to a raised position (Position 3) wherein it is oriented at a selected height above the surface of the ramp 22A. In the different positions, the adjustable lip 24A can be adjusted vertically to vary the elevation and angle of the flow of water 16 (supercritical flow) and enters the tailwater 48A (FIG. 2A) where the flow transitions—via a hydraulic jump to subcritical flow.

In Position 3 (FIG. 2A) the downstream end of the adjustable lip 24A can be located at a depth of from about 6 inches to 2 feet below the surface 30A (FIG. 2A) of the flow of water 16. This depth can be selected such that the water craft 19 (FIG. 1) encounter a hydraulic formation 46 that is more retentive (i.e. a hole or A), so that craft are less likely to strike the adjustable lip 24A. The lip 24A can have a downward limit so as to reduce the chances of forming a hydraulic formation 46B. The adjustable lip 24A can also be oriented at an desired angle relative to the surface of the ramp 22A or to the surface of the invert 26A of the channel 14-1 (FIG. 1A), 14-2 (FIG. 1B). For example, the adjustable lip 24A can be located at an angle of from 130 degrees to 230 degrees relative to the surface of the ramp, or at an angle of from 45 degrees (upward) to 45 degrees (downward) relative the invert 26A of the channel 14-1 (FIG. 1A), 14-2 (FIG. 1B).

The base 28A (FIG. 2A) for the adjustable lip 24A can be formed of a solid material such as concrete, grouted concrete or steel anchored to the invert 26A (FIG. 2A) of the channel 14-1 (FIG. 1A), 14-2 (FIG. 1B). In addition, the base 28A can include a invert portion 31A, a vertical portion 33A and a shaped portion 35A configured as a support for the placement mechanism 36A. The adjustable physical structure 12A (FIG. 2-2A) can also include adjustable wing wall structures 12C, or adjustable wing wall block structures 12E, configured to control the formation of the hydraulic formation 12A and resist the tailwater 48A from collapsing into the lower water surface 30A above the horizontal member 40A As will be further explained, the adjustable wing walls 32A can be formed of interlocking blocks 34A.

The adjustable lip physical structure 12A (FIGS. 2-2A) can also include an adjustable placement mechanism 36A configured to pivot or otherwise move the adjustable lip 24A to the selected position (e.g., Positions 1-3). As shown in FIG. 2A, the placement mechanism 36A can comprise an inflatable bladder, which can be inflated or deflated as required to place the adjustable lip 24A at the selected position. U.S. Pat. No. 7,114,879 to Obermeyer describes this type of inflatable bladder. With the placement mechanism 36A formed as an adjustable bladder, the adjustable lip 24A is preferably weighted to resist the hydraulic forces which tend to force the adjustable lip up and out of the flow of water 16A. Alternately, the placement mechanism 36A can comprise a hydraulic cylinder or an adjustable mechanism such as a mechanical jack. In this case the hydraulic cylinder or adjustable mechanism helps to lock the adjustable lip 24A in the selected position (e.g., Positions 1-3). The adjustable lip physical structure 12A (FIG. 2-2A) can also include a grate 56A configured to prevent debris, whitewater recreationalist 11, and water crafts 19 from getting under the adjustable physical structure or affecting the operation of the adjustable lip 24A.

During operation of the adjustable lip physical structure 12A (FIGS. 2-2A), the adjustable lip 24A can be placed in the selected position (e.g., Positions 1-3) to form a desired hydraulic formation 46A (FIG. 2A) in the tailwater 48A (FIG. 2A) downstream of the adjustable lip physical structure 12A. For example, depending on the position of the adjustable lip 24A, the hydraulic formation 46A (FIG. 2A) can comprise a wave or hole of a selected height and shape. For example, the hydraulic formation 46A can comprise an A-jump which is characterized by the jump breaking at or upstream of the abrupt drop, (hole or retentive wave) (2) the wave jump or W-jump or the wave train which are characterized by the presents of waves, and (3) the B-jump which is characterized by a plunging jet (hole, or downstream formed wave).

Referring to FIGS. 2B-2E and FIGS. 2F-2I, optional wave shaper extensions 50A-50D for the adjustable lip physical structure 12A are illustrated. The wave shaper extensions 50A-50D are configured to vary the shape and character of the hydraulic formations 46A (FIG. 2A). In each embodiment the wave shaper extension 50A-50D bolts or otherwise attaches to the vertical member 38A of the adjustable lip 24A. The surface can be in the same plain as the surface of the horizontal element 40A (FIG. 2A) of the adjustable lip 24A or can be angled upward from 0 degrees to 30 degrees or downward from 0 degrees to 60 degrees.

Figures 2B, 2C, 2D, 2E, 2F, 2G, 2H, 2I:
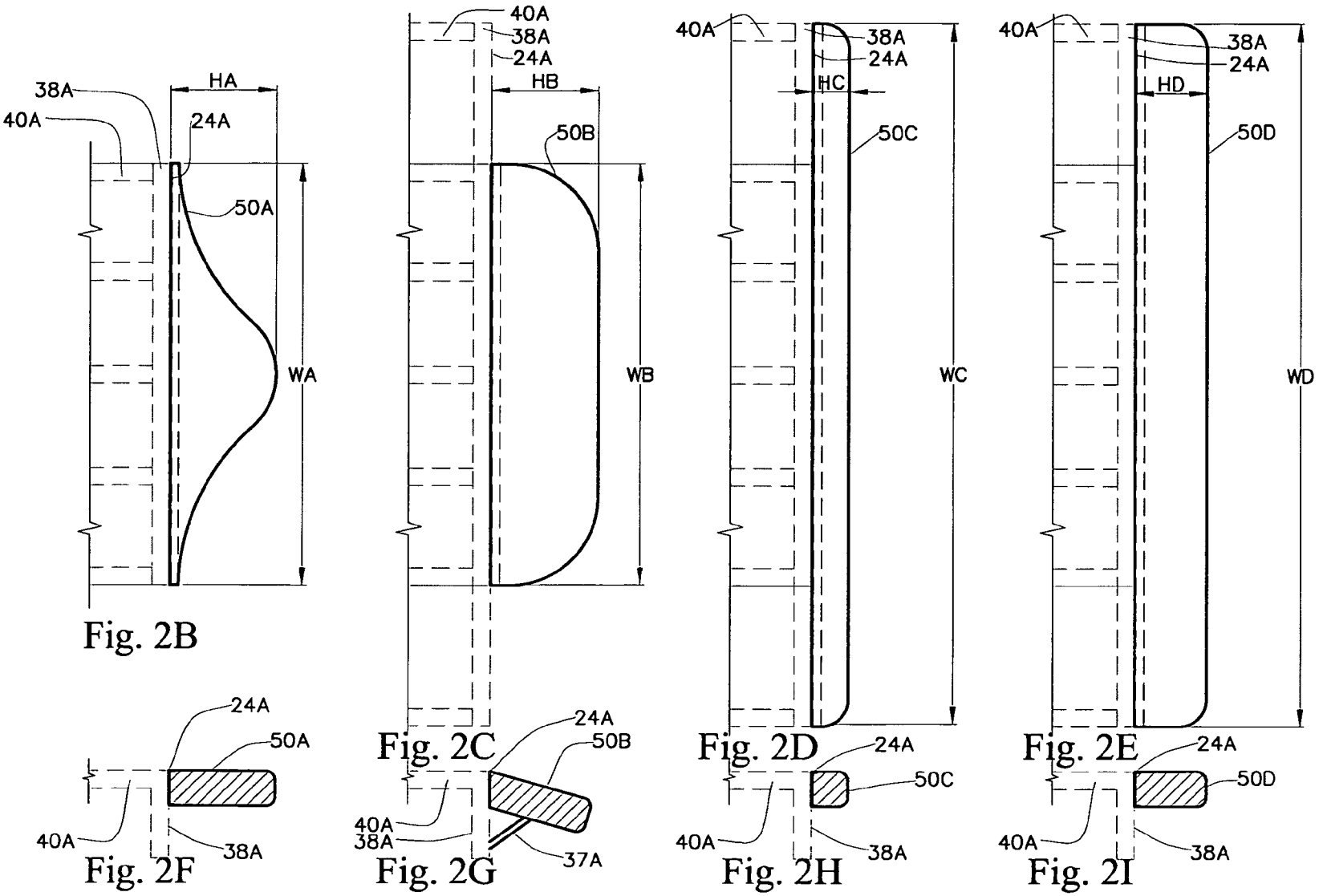
FIGS. 2B-2E are plan views of optional wave shaper extensions for the adjustable physical structure of FIG. 2.
FIGS. 2F-2I are end views of the optional wave shaper extensions shown in FIGS. 2B-2E.

In FIG. 2B, a wave shaper extension 50A has the shape a bell or a hillock with a selected height Ha and a selected width Wa. A representative value for Ha 24 can be from 0.5 feet to 6 feet. A representative value for Wa can be from be from 120 percent to 20 percent of the width of the horizontal element 40A (FIG. 2A) of the adjustable lip In FIG. 2B, a wave shaper extension 50B has the shape of a paddle with a selected height Hb and a selected width Wb. Representative values for Hb and Wb are the same described for wave shaper extension 50A. In FIG. 2C, a wave shaper extension 50C has the shape of a paddle with a selected height Hc and a selected width Wc. Representative values for Hb and Wb are the same described for wave shaper extension 50A. In FIG. 2D, a wave shaper extension 50D has the shape of a paddle with a selected height Hd and a selected width Wd. Representative values for Hb and Wb are the same described for wave shaper extension 50A. Wave shaper extension 50B is shown oriented with a downward slope in FIG. 2G, but all wave shaper extensions can be sloped upward or downward. The slope of the wave shaper extension can be adjusted with a placement mechanism 37B to adjust the slope as required. In each embodiment the wave shaper extension 50A-50D can be formed of a durable material such as metal or plastic. In addition, the surface of the wafer shaper extension 50A-50D can be perforated, textured or otherwise shaped to further control the resultant hydraulic formation 46A-46D.

Figure 2J:
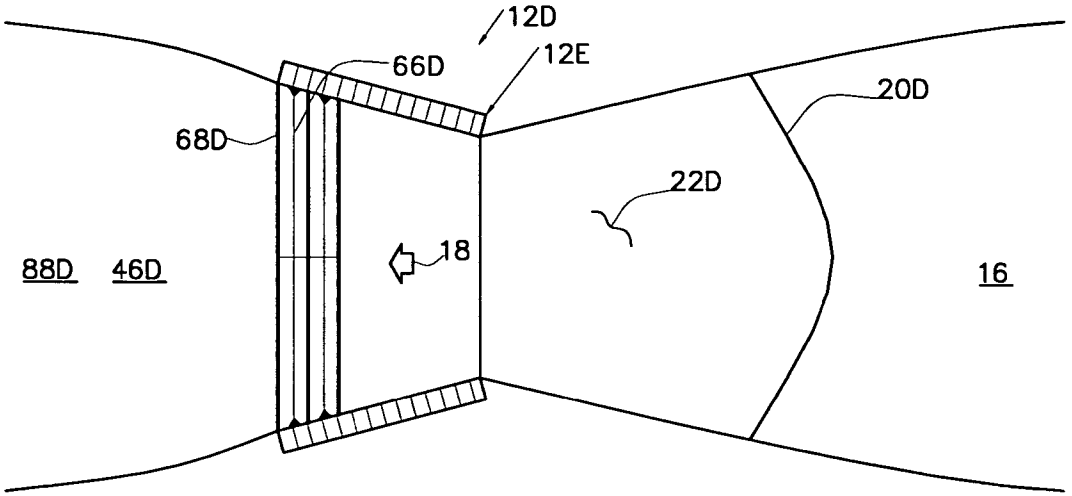
FIG. 2J is a plan view of an optional lip block wave shaper.
Figure 2K:
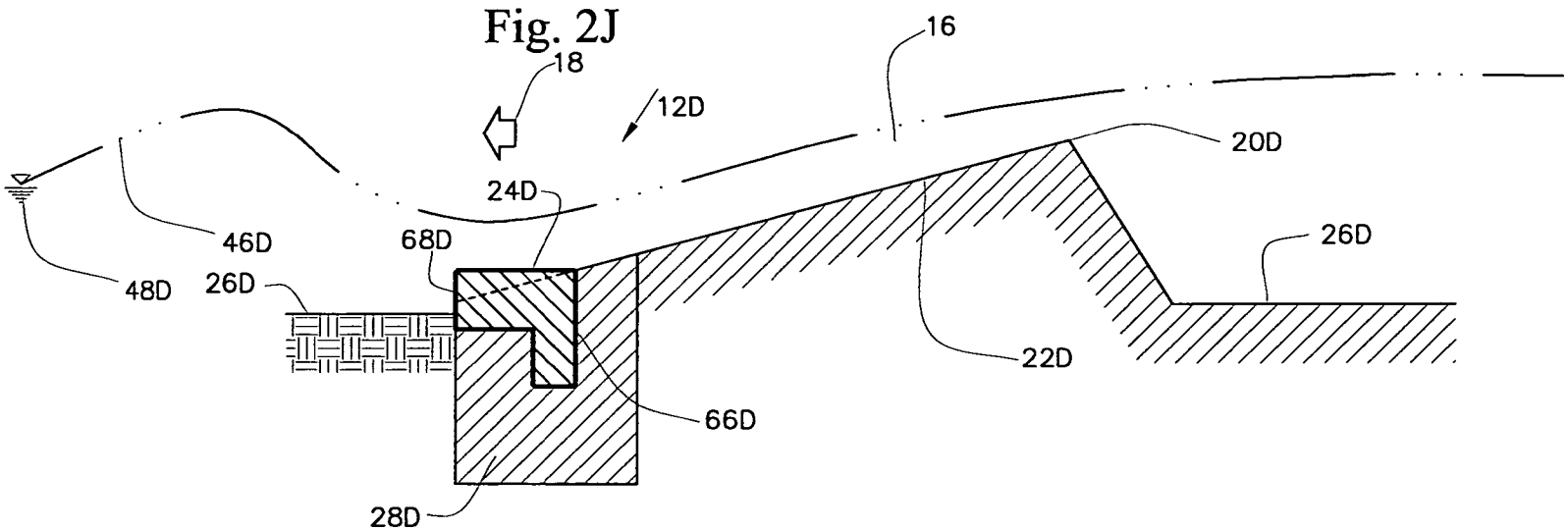
FIG. 2K is a cross sectional view of the lip block wave shaper of FIG. 2J.

Referring to FIGS. 2J and 2K, an adjustable lip block physical structure 12D is illustrated. The adjustable lip block physical structure 12D performs the objectives similar to the adjustable lip physical structure 12A (FIG. 2A) but without the adjustable lip 24A (FIG. 2A). The adjustable lip block physical structure 12D includes a crest 20D and a ramp 22D substantially similar to the previously described crest 20 (FIG. 2A) and ramp 22 (FIG. 2A). In addition, the ramp 22A can also have a shape which converges the flow of water 16 towards the adjustable lip 24A such that a more focused v-shaped hydraulic formation is produced (shown in FIG. 2J). The ramp 22A can also have a shape which diverges the flow of water 16 towards the adjustable lip 24A such that a broader hydraulic formation is produced. The adjustable lip block physical structure 12D also includes a base 28D formed of concrete or other suitable material, and an L-shaped lip block 66D mounted or "keyed" to the base 28D. The lip block shown 66D forms a vertical lip 68D adjacent to the invert 26D of the channel 14-1 (FIG. 1A), 14-2 (FIG. 1B) which functions substantially similarly to the previously described adjustable lip 24A (FIG. 2A) to form a desired hydraulic formation 46D. Various configuration and sizes of lip blocks can be placed into the base 28D to form different hydraulic formations 46D. Alternate shapes of lip blocks 66D includes downward and upward sloping adjustable lip which can slope from 45 degrees downward to 45 degrees upward. Lip blocks can also have a vertical lip 68D that is higher or lower than the base 28D. Different lip blocks 66D can also be used in the same base 28D to form various hydraulic formations 46D.

Figure 3:
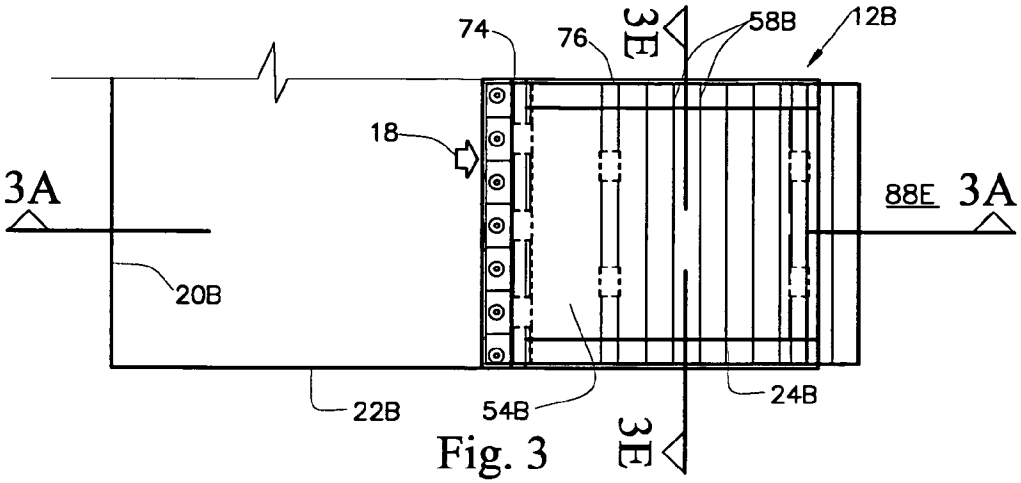
FIG. 3 is a plan view of an adjustable through-flow physical structure taken along line 3 of FIGS. 1A and 1B.
Figure 3B:
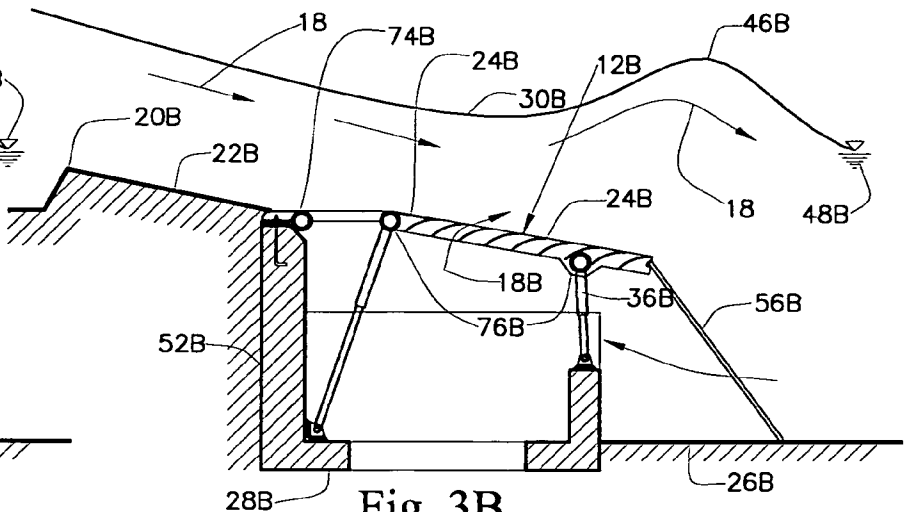
FIG. 3B is a cross sectional view equivalent to FIG. 3A showing the adjustable through-flow physical structure in a lowered position.
Figure 3A:
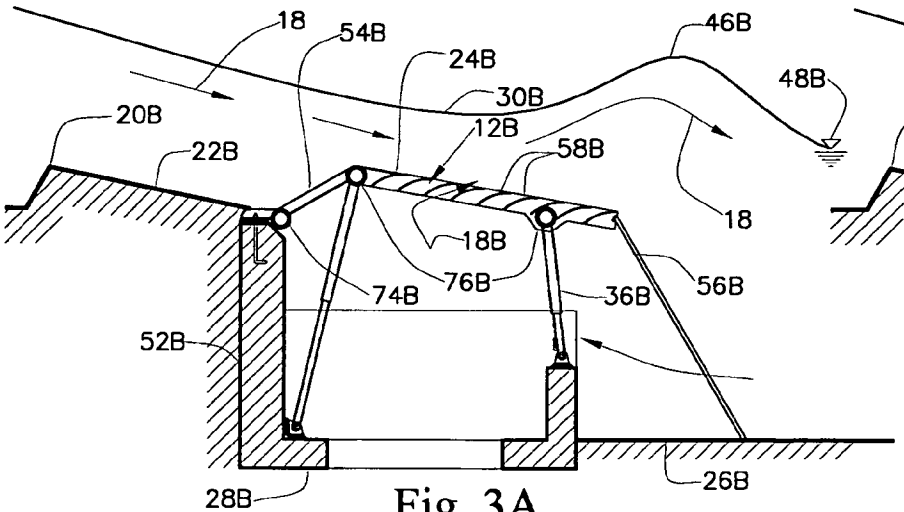
FIG. 3A is a cross sectional view taken along section line 3A-3A of FIG. 3 showing the adjustable through-flow physical structure in a raised position.

Referring to FIGS. 3, 3A, 3B, 3C, 3D and 3E, an adjustable through-flow physical structure 12B is illustrated. As shown in FIGS. 3A and 3B, the adjustable through-flow physical structure 12B is located on a stepped invert 26B of the channel 14-1 (FIG. 1A), 14-2 (FIG. 1B) having a vertical drop 52B. The adjustable through-flow physical structure 12B includes a crest 20B and a ramp 22B which function substantially as previously described. The adjustable through-flow physical structure 12B also includes a base 28B, and a through-flow adjustable lip 24B. The base 28B can be formed of concrete or other building material placed along the vertical drop 52B on the invert of the channel 26B. The adjustable through-flow physical structure 12B increases the effective flow in the hydraulic formation 12 B and decreases the Froude Number of the flow 16 as it passes over the shaped vanes 58 B or perforations. The adjustable through-flow structure is shown and described as a lip 24B, however it can also be configured into the ramp 22B. For instance it could be readily included into the ramp 22F or 86G as described below.

As shown in FIGS. 3A and 3B, the adjustable through-flow physical structure 12B also includes a plurality of adjustable placement mechanisms 36B attached to the base 28B configured to place the adjustable through-flow lip 24B in a desired position in the flow of water 16. In FIGS. 3A and 3B, the adjustable through-flow physical structure 12B is shown in two different positions. In FIG. 3A, the adjustable through-flow lip 24B is in a "raised" position located in the flow of water 16 above the lowest point of ramp 22B. In FIG. 3B, the adjustable through-flow lip 24B is in a "lowered position" located in the flow of water 16 above the lowest point of the ramp 22B. However, the illustrated positions ("raised" and "lowered") are merely exemplary, as the adjustable through-flow lip 24B can be placed in any desired position in the flow of water 16. By way of example, the adjustable through-flow lip 24B can be placed from the tailwater surface to 5 feet below the tailwater surface 48B, at an angle of from 30 degrees upward to 45 degrees downward relative to the invert 26B of the channel 14-1 (FIG. 1A), 14-2 (FIG. 1B) or tailwater surface 48B.

As shown in FIGS. 3A and 3B, the adjustable through-flow physical structure 12B can also include a linkage plate 54B which is pivotably attached to the base 28B and to the adjustable through-flow lip 24B. The linkage plate 54B serves as an attachment member for attaching the adjustable through-flow lip 24B to the base 28B. If included, the linkage plate 54B allows adjustment of the vertical elevation of the flow of water 16 as it enters the downstream pool 88B. The adjustable through-flow physical structure 12B also includes a grate 56B attached to the adjustable through-flow lip 24B and slidably supported by the invert 26B of the channel 14-1 (FIG. 1A), 14-2 (FIG. 1B). The grate 56B prevents debris from accumulating in the water proximate to the adjustable through-flow physical structure 12B and can prevent whitewater recreationalists 11, and water crafts 19 from getting under or into the adjustable flow-through physical structure 12B or affecting the operation of the adjustable flow-through lip 24B.

Figure 3C:
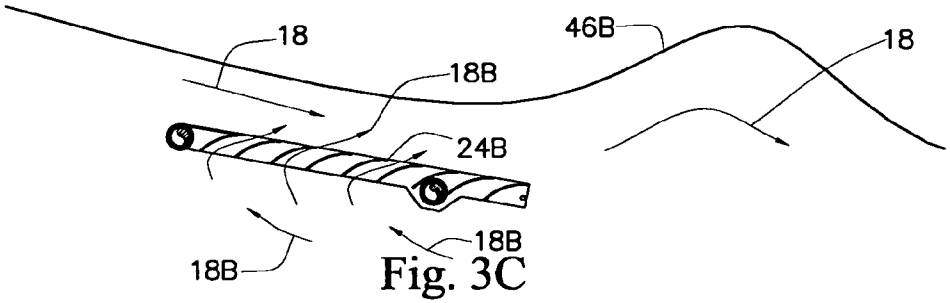
FIG. 3C is a schematic cross sectional view showing the operation of an adjustable lip of the adjustable through-flow physical structure.

As also shown in FIGS. 3A, 3B and 3C, the adjustable through-flow lip 24B can include a plurality of shaped vanes 58B configured to direct water and allow water to flow freely as indicated by flow arrows 18B through the adjustable through-flow lip 24B. In addition, the shaped vanes 58B (FIG. 3B) can have a curved shaped similar to turbine blades, which function to further shape the hydraulic formations 46B (FIGS. 3A and 3B) in the tailwater 48B (FIGS. 3A and 3B) downstream of the adjustable lip physical structure 12A. For example, depending on the position of the adjustable through-flow lip 24B, the hydraulic formation 46B (FIGS. 3A and 3B) can comprise a wave substantially as previously described. Alternately, in place of shaped vanes 58B, the through-flow adjustable lip 24B can include holes, perforations, channels, slats, flat vanes, or other members that direct and allow water to flow freely through the adjustable flow-through lip 24B.

The placement mechanisms 36B (FIGS. 3A and 3B) can comprise adjustable mechanisms such as jacks or hydraulic cylinders which are pivotably attached to the base 28B and to the through-flow adjustable lip 24B. The placement mechanism can also be an inflatable bladder as shown in FIG. 2A. As shown in FIGS. 3A and 3B, the placement mechanisms 36B, in combination with the adjustable through-flow lip 24B and the linkage plate 54B, form a four bar linkage that allows the adjustable through-flow lip 24B to be placed in any desired position, and with any desired orientation relative to the flow of water 18 in the channel 14-1 (FIG. 1A), 14-2 (FIG. 1B).

Figure 3D:
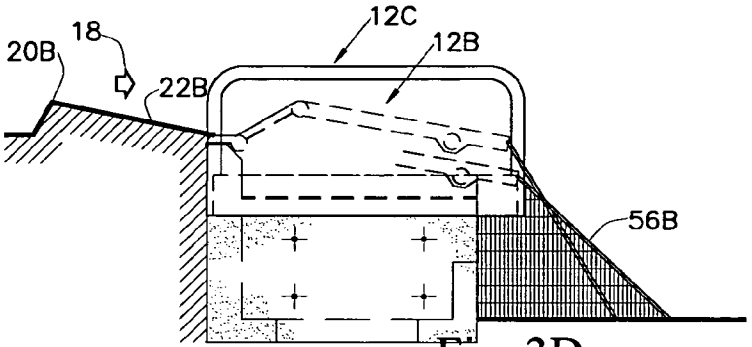
FIG. 3D is a cross sectional view equivalent to FIG. 3A showing the adjustable through-flow physical structure with an optional cover.
Figure 3E:
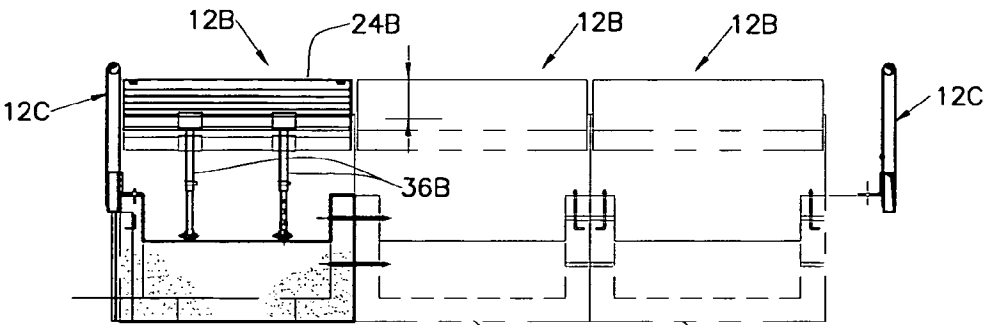
FIG. 3E is a cross sectional view taken along section line 3E-3E of FIG. 3 showing the adjustable through-flow physical structure along side identical adjustable through-flow physical structure in phantom lines.

FIG. 3D illustrates adjustable wing wall physical structures 12C in combination with the adjustable through-flow physical structure 12B. The structure and function of the adjustable wing wall physical structures 12C will be more fully explained in the paragraphs to follow. FIG. 3E illustrates three adjustable through-flow physical structure 12B placed in series across the channel 14-1 (FIG. 1A) or 14-2 (FIG. 1B).

Figures 4, 4A, 4B:
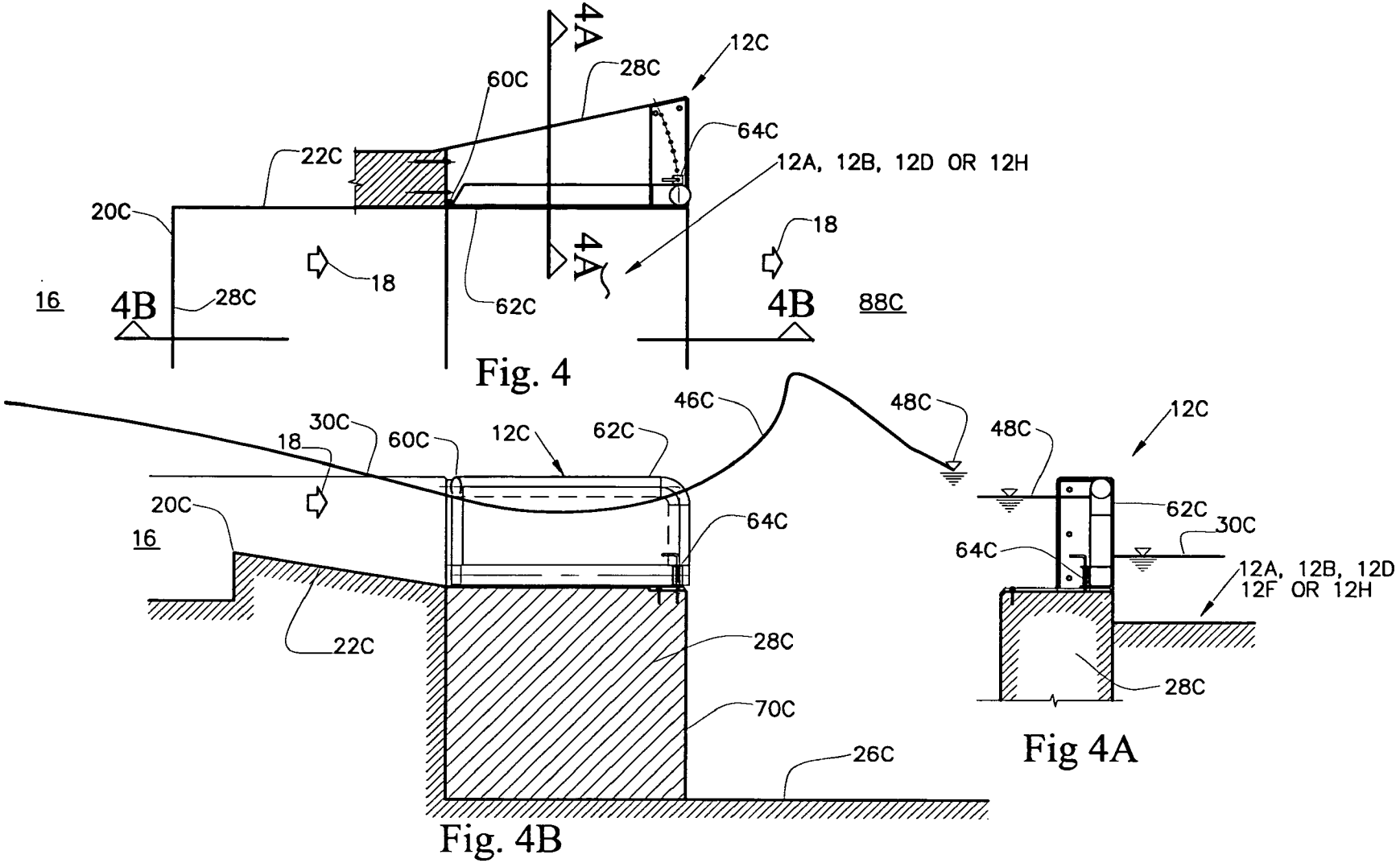
FIG. 4 is a plan view of an adjustable wing wall physical structure taken along line 4 of FIGS. 1A and 1B.
FIG. 4A is a cross sectional view taken along section line 4A-4A of FIG. 4.
FIG. 4B is a cross sectional view taken along section line 4B-4B of FIG. 4.

Referring to FIGS. 4, 4A and 4B, an adjustable wing wall physical structure 12C is illustrated. The adjustable wing wall physical structure 12C is configured to control the formation of the hydraulic formation 46C and resist the tailwater 48C from collapsing into the lower water surface 30 above the lip 24A,24B,24D,24F. For example, the adjustable wing wall physical structure 12C can be located adjacent to, or in close proximity to, the adjustable through-flow physical structure 12B (FIG. 3D), or any other adjustable physical structure herein described. The adjustable wing wall physical structure 12C includes a base 28C made of concrete or other suitable material. The base 28C (FIG. 4B) can include a crest 20C (FIG. 4B) and a ramp 22C (FIG. 4B) constructed substantially as previously described. The base 28C (FIG. 4B) can also include a vertical drop 70C (FIG. 4B) downstream of the adjustable wing wall physical structure 12C. The adjustable wing wall physical structure 12C also includes a hinge plate 60C attached to an upstream end of the stepped base 28C, and a face plate 62C attached to the hinge plate 60C. The hinge plate 60C allows the steel, ridged, inflated, or pliable face place 62C to be pivoted or rotated into or out of the flow of water 16. The face plate 62C can also be made so as to allow vertical adjustment to further control the formation of the hydraulic formation 46C and resist the tailwater 48C from collapsing into the lower water surface 30C above the adjustable lip physical structure 12A or adjustable lip block physical structure 12D.

The adjustable wing wall physical structure 12C (FIGS. 4, 4A and 4B) also includes a locking mechanism 64C for the steel face plate 62C attached to the stepped base 28C. In FIGS. 4, 4A and 4B, the steel face plate 62C is shown in a locked or "closed" position. In the "closed" position, the steel face plate 62C forms a sidewall of the channel 14-1 (FIG. 1A) or 14-2 (FIG. 1B), such that the flow of water 16 in the channel 14-1 or 14-2 is constrained by the steel face plate 62C. Alternately, the steel face plate 62C can be pivoted upward about the hinge plate 60C out of the flow of water 16 to an "open" position. In the "open" position, the flow of water 16 is constrained by the base 28C, such that the width of the channel 14-1 (FIG. 1A), 14-2 (FIG. 1B) has been effectively increased. In the "closed" position the flow of water is constrained by the steel face plate 62C such that the width of the channel 14-1 (FIG. 1A), 14-2 (FIG. 1B) has been effectively decreased. The dimensions and the geometry of the steel face plate 62C can be varied as required for different applications.

Figures 5, 5A, 5B:
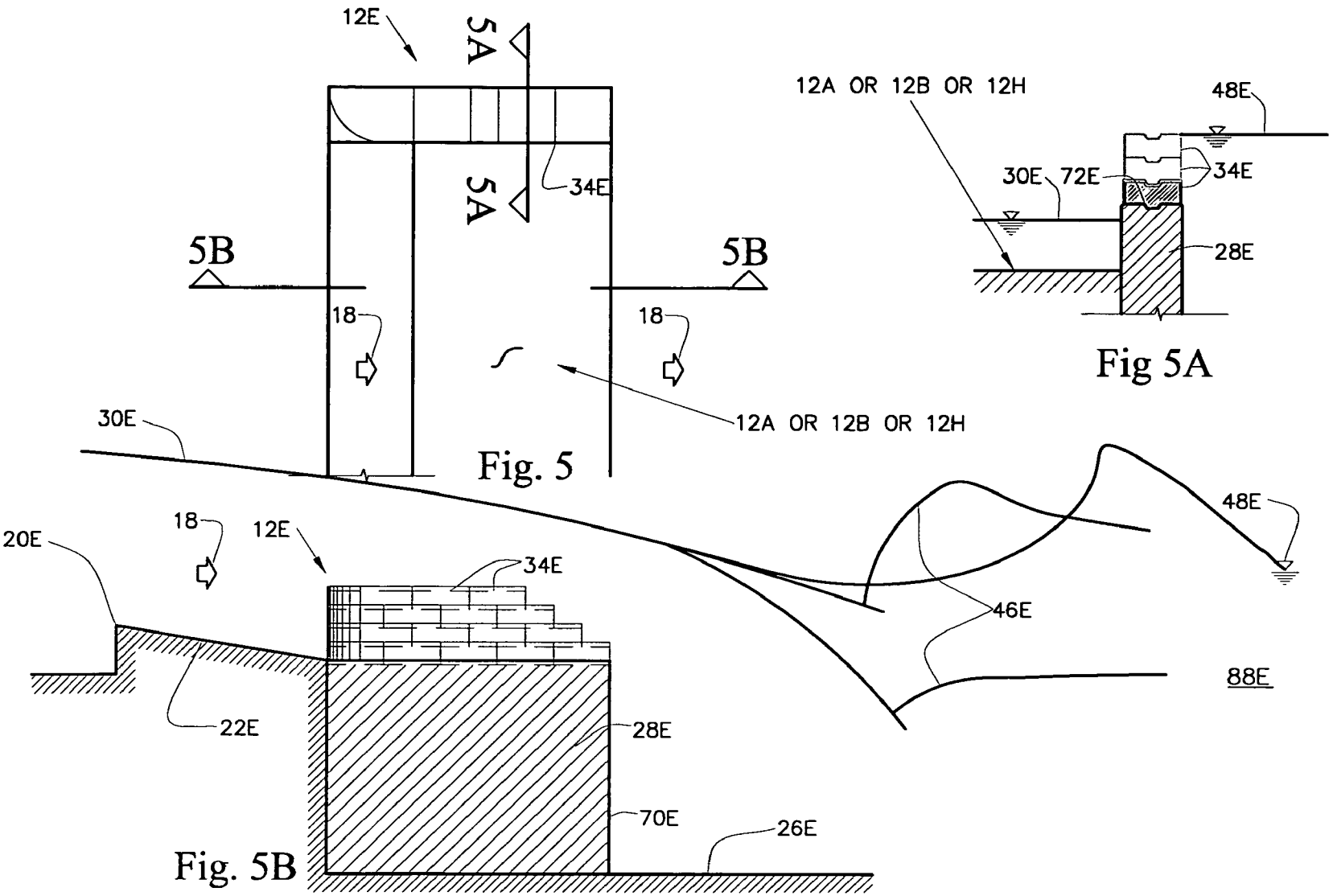
FIG. 5 is a plan view of an adjustable wing wall physical structure taken along line 5 of FIGS. 1A and 1B.
FIG. 5A is a cross sectional view taken along section line 5A-5A of FIG. 5.
FIG. 5B is a cross sectional view taken along section line 5B-5B of FIG. 5.

Referring to FIGS. 5, 5A and 5B, an adjustable block wing wall physical structure 12E is illustrated. The adjustable block wing wall physical structure 12E is configured to adjust the width of the channel 14-1 (FIG. 1A), 14-2 (FIG. 1B). The adjustable block wing wall physical structure 12E can be located adjacent to, or in close proximity to, the adjustable lip physical structure 12A (FIG. 2A), or any other adjustable physical structure herein described. It can be configured to control the hydraulic formation 46D and resist the tailwater 48D from collapsing into the lower water surface 30D above the adjustable lip physical structure 12A or the adjustable lip block physical structure 12 E.

The adjustable block wing wall physical structure 12E includes a base 28E made of concrete or other suitable material. The base 28E (FIG. 5B) can include a crest 20E (FIG. 5B) and a ramp 22E (FIG. 5B) constructed substantially as previously described. The base 28E (FIG. 5B) can also include a vertical drop 70E (FIG. 5B) downstream of the adjustable block wing wall physical structure 12E. The adjustable block wing wall physical structure 12E is constructed of individual lip blocks 34E that are shaped with mating keys/grooves 72E (FIG. 5A) such that the lip blocks 34E can be stacked vertically. This allows the height of the adjustable block wing wall physical structure 12E to be adjusted as required.

Figure 6:
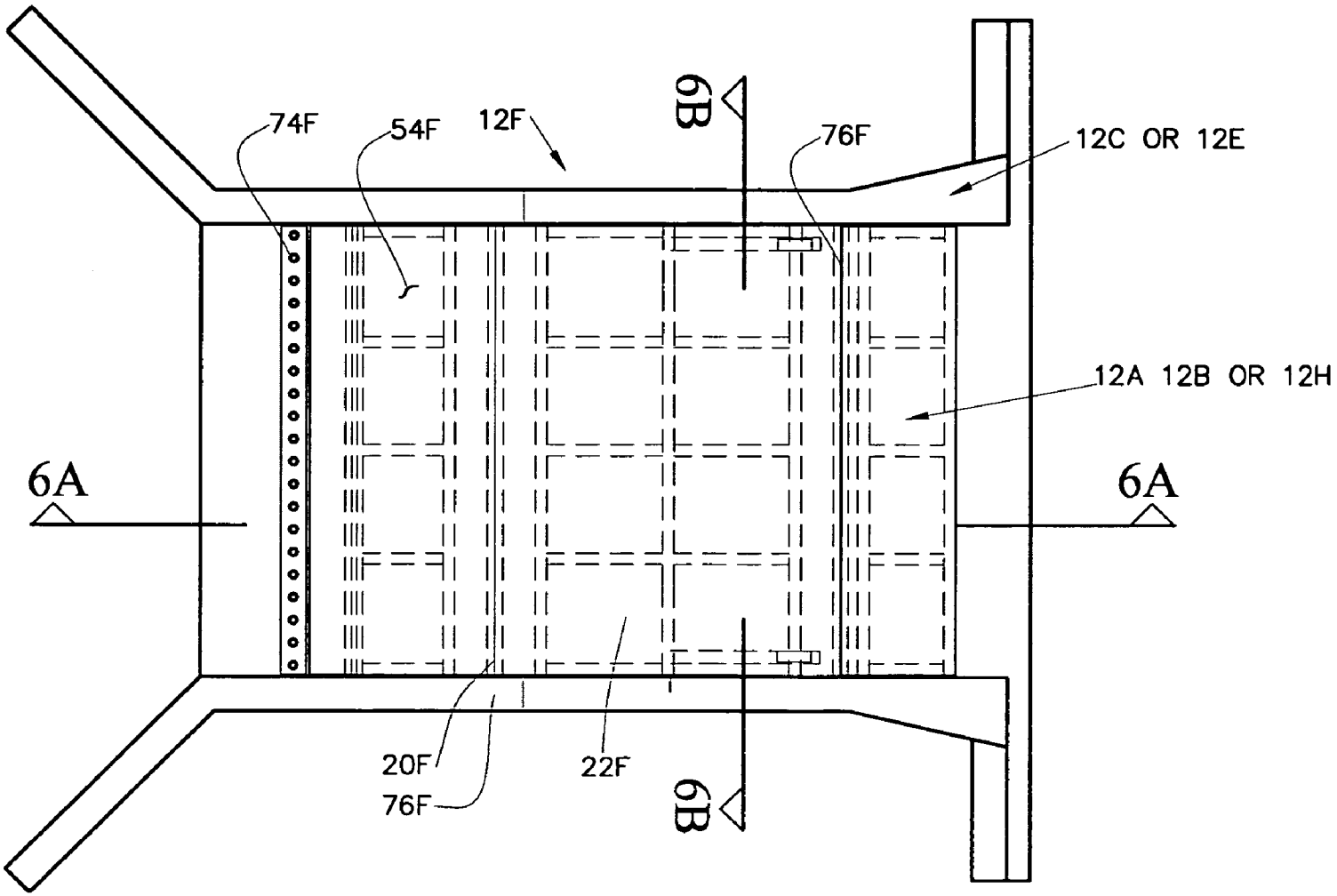
FIG. 6 is a plan view of an adjustable physical structure taken along line 6 of FIGS. 1A and 1B.
Figure 6A:
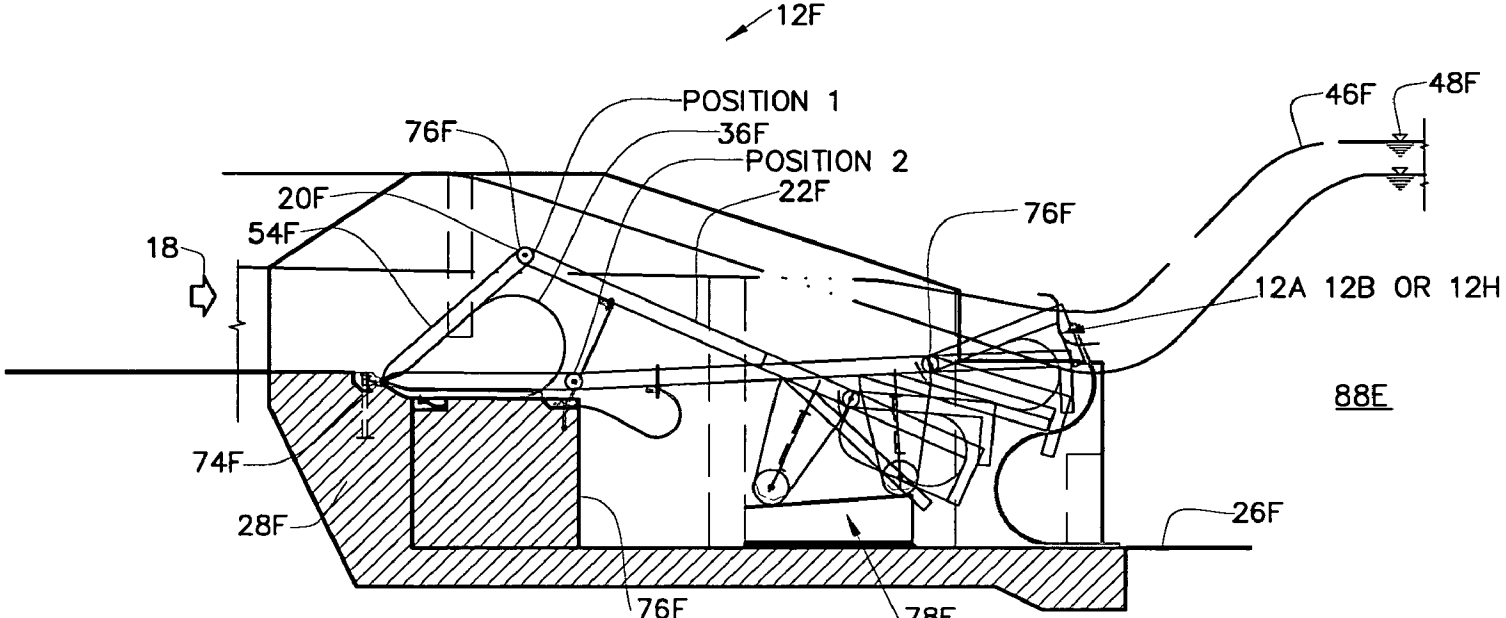
FIG. 6A is cross sectional view taken along section line 6A-6A of FIG. 6.
Figure 6B:
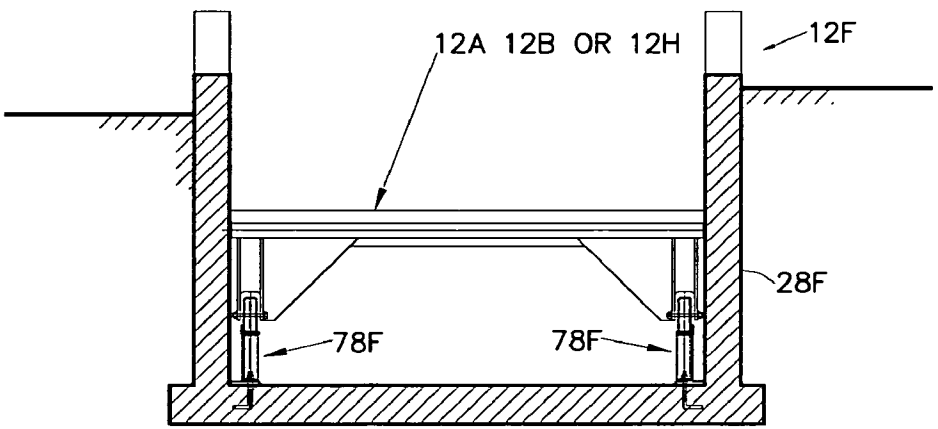
FIG. 6B is cross sectional view taken along section line 6B-6B of FIG. 6.

Referring to FIGS. 6, 6A and 6B, an adjustable crest physical structure 12F is illustrated. The adjustable crest physical structure 12F includes an adjustable crest 20F (FIG. 6A) configured to adjust the amount of hydraulic drop across the adjustable crest physical structure 12F. The hydraulic drop is the difference in elevation between the water surface upstream and the water surface downstream of the adjustable crest physical structure 12F. The adjustable crest 20F (FIG. 6A) functions substantially similar to the previously described static crest 20A (FIG. 2A) of the adjustable lip physical structure 12A (FIG. 2A). The adjustable crest physical structure 12F also includes an adjustable ramp 22F (FIG. 6A), which functions substantially similar to the previously described static ramp 22A (FIG. 2A) of the adjustable lip physical structure 12A (FIG. 2A). The adjustable crest physical structure 12F (FIG. 6A) also includes an adjustable lip 24F, which functions substantially similar to the previously described adjustable lip 24A (FIG. 2A) of the adjustable lip physical structure 12A (FIG. 2A).

As shown in FIG. 6A, the adjustable crest physical structure 12F includes a base 28F formed of a suitable building material such as concrete. The adjustable crest 20F is hingedly mounted to the base 28F on one or more hinge connections 74F (FIG. 6A). The adjustable crest 20F is movable from Position 1, termed the "up" position, to Position 2, termed the "down" position. In the "down" position the adjustable crest physical structure 12F can have one-half foot or less of hydraulic drop. In the "up" position the adjustable crest physical structure 12F can have as much as eight feet or more of hydraulic drop. The adjustable ramp 22F is hingedly mounted to the adjustable crest 20F on one or more hinge connections 76F (FIG. 6A).

As also shown in FIG. 6A, the adjustable crest physical structure 12F includes a placement mechanism 36F such as a bladder, hydraulic cylinder or mechanism substantially as previously described. The placement mechanism 36F moves the adjustable crest 20F to the different positions. The adjustable crest physical structure 12F also includes a fixed or variable track slide mount 78F (FIG. 6A) attached to the end of the adjustable ramp 22F. With this arrangement, movement of the adjustable ramp 22F in the vertical direction also moves the adjustable ramp 22F in the horizontal direction. The track slide mount 78F (FIG. 6A) can be adjusted so that the end of the adjustable ramp 22F can be lower or higher with the adjustable crest physical structure 12F in the "up" position then in the "down" position. The adjustable lip 24F (FIG. 6A) can be fixedly attached to the adjustable ramp 22F or can be pivotably attached and operated by a second bladder, hydraulic cylinder or mechanism (not shown). The adjustable crest physical structure 12F can be operated in substantially the same manner as the adjustable lip physical structure 12A for producing various hydraulic formations 46F (FIG. 6A).

Figure 7:
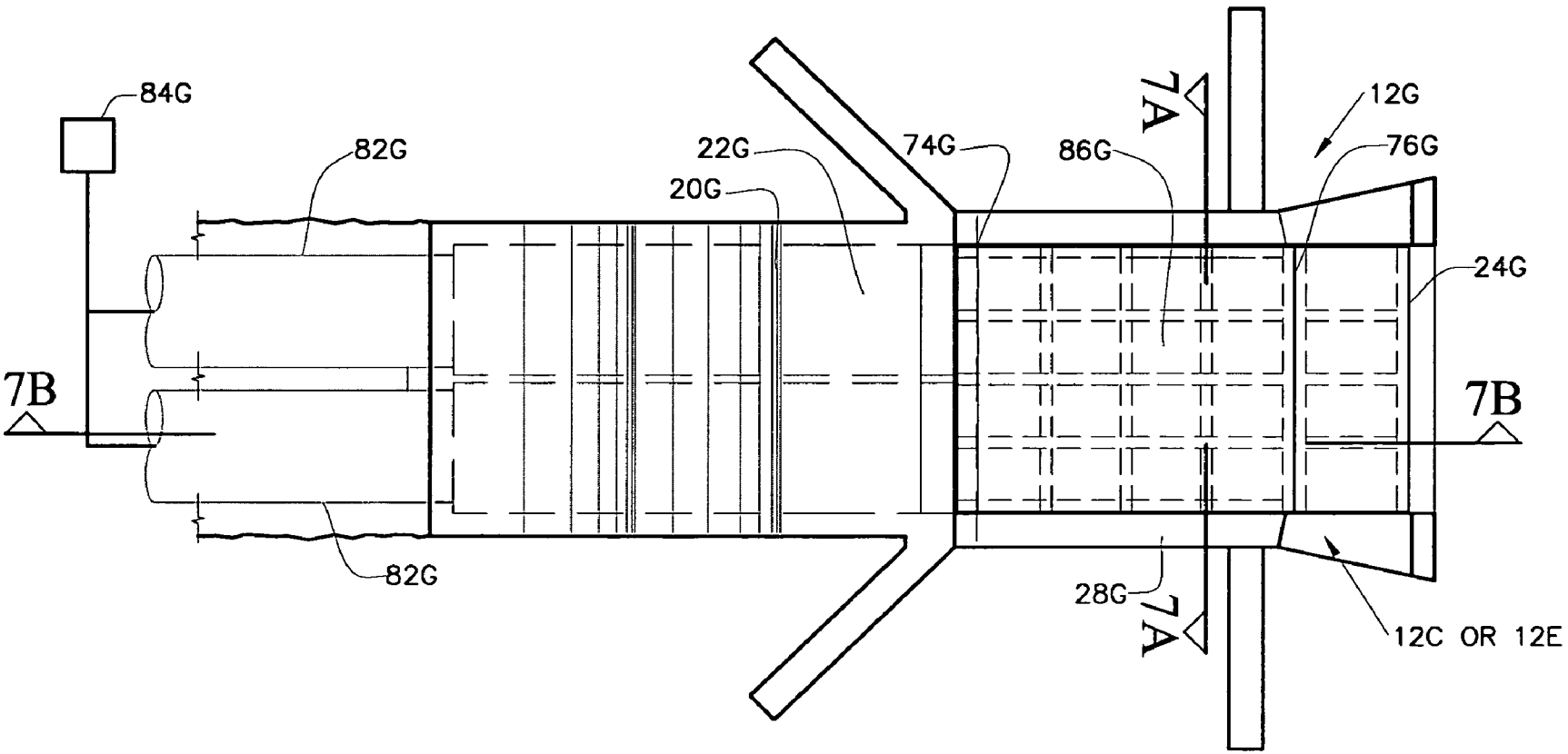
FIG. 7 is a plan view of an adjustable physical structure integrated into the outlet of a conveyance structure such a pump outlet. The section is taken along line 7 of FIGS. 1A and 1B.
Figure 7A:
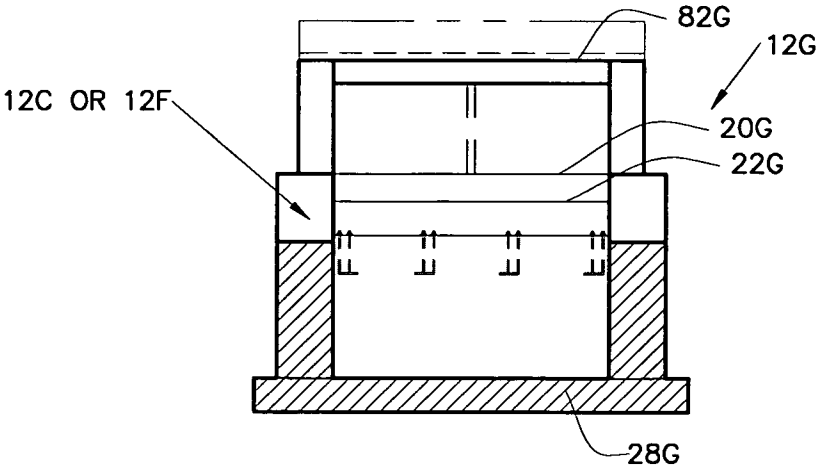
FIG. 7A is a cross sectional view taken along section line 7A-7A of FIG. 7.
Figure 7B:
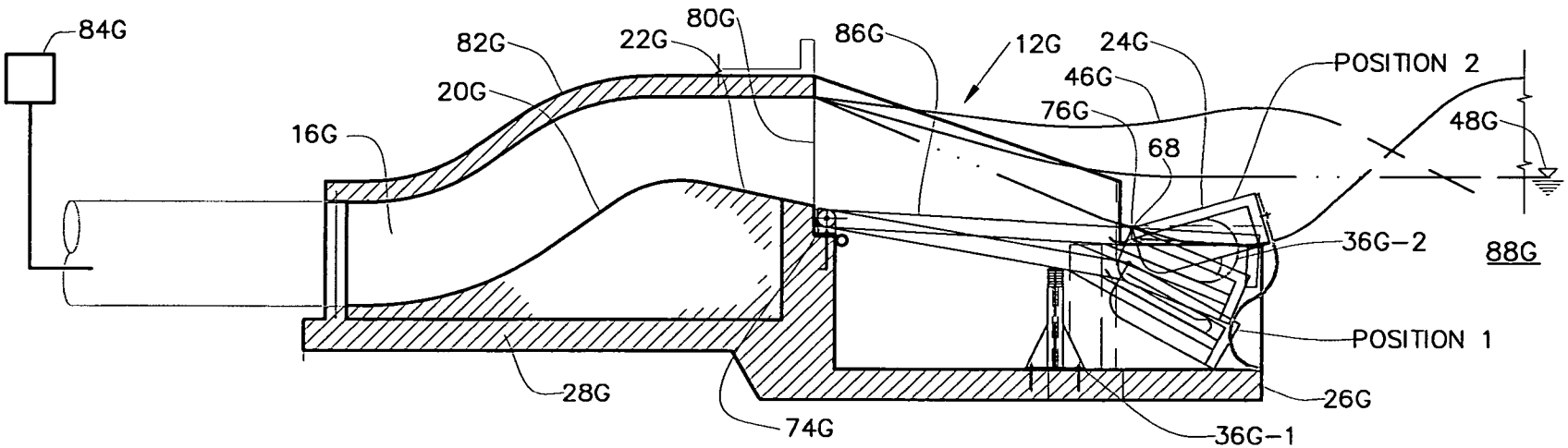
FIG. 7B is a cross sectional view taken along section line 7B-7B of FIG. 7.

Referring to FIGS. 7, 7A and 7B, an adjustable outlet physical structure 12G is illustrated. The adjustable outlet physical structure 12G connects to the outlets 80G of one or more conveyance structures 82G such as conduits or channels hence the term "adjustable outlet". The conveyance structures 82G are connected to a source of water 84G (FIG. 7B), such as a pump, a channel, or a pipe configured to supply a flow of water 16G (FIG. 7B) at a suitable flow rate and velocity. By way of example, the flow of water 16G can be from 30 cfs (cubic feet per second) to 2000 cfs (cubic feet per second) or more and at a Froude Number from 1.2 to 4.

The adjustable outlet physical structure 12G (FIG. 7B) includes a crest 20G (FIG. 7B) configured to provide a hydraulic drop across the outlet adjustable physical structure 12G. The crest 20G (FIG. 7B) functions substantially similar to the previously described crest 20A (FIG. 2A) of the adjustable lip physical structure 12A (FIG. 2A). The crest 20G (FIG. 7B) is preferably formed at an elevation above the downstream water surface elevation to prevent backflow or reverse flow from downstream pools when there is no flow of water 16G (FIG. 7B) in the conduits 82G (FIG. 7B).

The adjustable outlet physical structure 12G (FIG. 7B) also includes a ramp 22G (FIG. 7B), which functions substantially similar to the previously described ramp 22A (FIG. 2A) of the adjustable lip physical structure 12A (FIG. 2A). The adjustable outlet physical structure 12G (FIG. 7B) can also include an adjustable ramp 86G (FIG. 7B), which functions substantially similar to the previously described adjustable ramp 22F (FIG. 6A). The adjustable outlet physical structure 12G (FIG. 7B) can also include an adjustable lip 24G, which functions substantially similar to the previously described adjustable lip 24A (FIG. 2A) of the adjustable lip physical structure 12A (FIG. 2A).

As shown in FIG. 7B, the adjustable outlet physical structure 12G includes a base 28G formed of a suitable building material, such as concrete. The adjustable ramp 22G is hingedly mounted to the base 28G on one or more hinge connections 74G (FIG. 7B). The adjustable ramp 22G is movable from Position 1, termed the "down" position, to Position 2, termed the "up" position, or to any desired position in between Positions 1 and Position 2. The ramp can be moved in this manner to account for variations in tailwater 48G elevation or changes in flow 16G rates.

As also shown in FIG. 7B, the outlet adjustable physical structure 12G includes one or more first placement mechanisms 36G-1 for moving the adjustable ramp 86G, and a second placement mechanism 36G-2 for moving the adjustable lip 24G. As previously described, the placement mechanisms 36G-1, 36G-2 can comprise bladders, hydraulic cylinders or jack mechanisms. In the illustrated embodiment, the first placement mechanisms 36G-1 comprise mechanical jacks, and the second placement mechanism 36G-2 comprises a bladder. The adjustable outlet physical structure 12G takes advantage of energy (in the form of velocity head) that would otherwise be "wasted" to produce a useable hydraulic formation 46G, such as a wave or a hole having side eddies.

With the source of water 84G (FIG. 7B) for the adjustable outlet physical structure 12G (FIG. 7B) being in the form of a pump, the adjustable outlet physical structure 12G (FIG. 7B) can be placed in a still pool, such as a lake, swimming pool or tank, or in a river or channel. The adjustable outlet physical structure 12G (FIG. 7B) can also be portable, as the source of water 84G (e.g., pump), the conduit 82G (FIG. 7B), the adjustable ramp 86G (FIG. 7B), and the adjustable lip 24G (FIG. 7B) can be easily transported and reassembled.

The source of water 84G (FIG. 7B) can comprise a conventional propeller or mixed-flow impellor pump. Alternately, the source of water 84G (FIG. 7B) can comprise a paddle wheel pump. One advantage of a paddle wheel pump is energy losses are reduced and efficiency is increased due to the desired nature of the pumped outflow. Specifically, the outflow of a paddle wheel pump has a low lift (less than 4 feet) and a high velocity (approximately 8 to 20 feet per second). The outflow of the paddle wheel pump can also be distributed across the width (cross section) of the adjustable outlet physical structure 12G (FIG. 7B). This output width can thus be achieved without the need to contract, and then expand the flow as is necessary with a conventional pump.

With the source of water 84G (FIG. 7B) in the form of either a pump or a paddle wheel, power can be supplied by an electric or gas engine or a water powered turbine. The return flow of the source of water 84G can be through the bottom and/or through the side of the outlet adjustable physical structure 12G (FIG. 7B). Flow routed through the bottom (below the adjustable lip 24G) enhances the formation of the hydraulic formation 46G (FIG. 7B), and decreases velocities at the downstream end of the downstream pool 88G (FIG. 7B). Flow routed through the side of the adjustable outlet physical structure 12G (FIG. 7B) can be used to decrease the intensity of the eddy if focused near the eddy line (i.e., the boundary between the eddy and the supercritical flow). In addition, the flow and formation of the hydraulic formation 46G (FIG. 7B) can be adjusted with the pumping rate.

Figures 8, 8A, 8B:
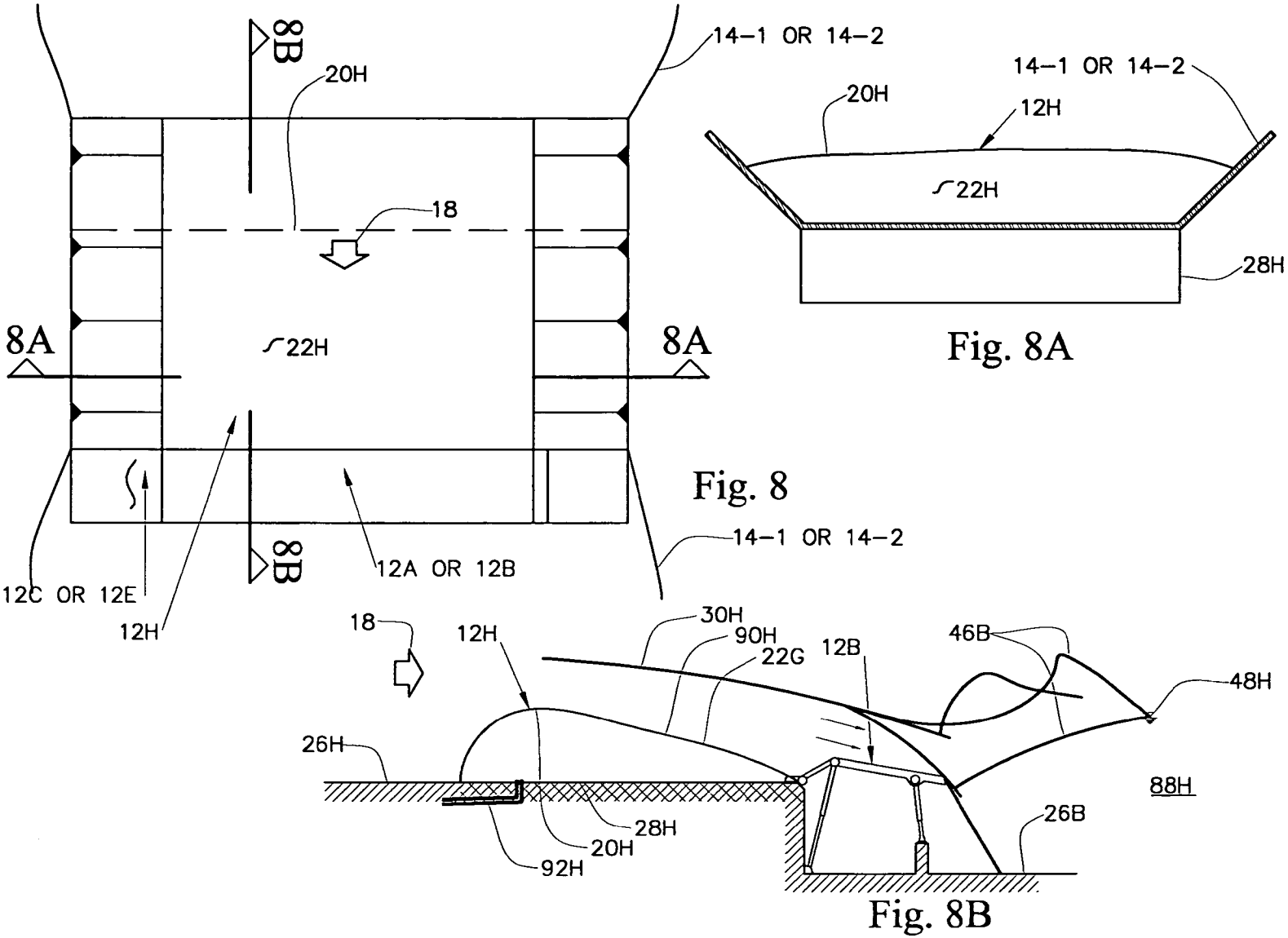
FIG. 8 is a plan view of an adjustable physical structure with an expandable or flexible membrane taken along line 8 of FIGS. 1A and 1B.
FIG. 8A is a cross sectional view taken along section line 8A-8A of FIG. 8.
FIG. 8B is a cross sectional view taken along section line 8B-8B of FIG. 8.

Referring to FIGS. 8, 8A and 8B, an expandable invert physical structure 12H is illustrated. The expandable invert physical structure 12H (FIG. 8B) comprises a reinforced rubber membrane that is inflated with either air or water. Exemplary reinforcing materials include nylon, polypropylene, Kevlar, steel, and other reinforcing fibers. The expandable invert physical structure 12H (FIG. 8B) can expand and rise according to a predetermined shape as controlled by the internal reinforcing. For typical applications, the expandable invert physical structure 12H (FIG. 8B) can range from 2 feet to 25 feet in length and from 6 feet to 25 feet in width.

The expandable invert physical structure 12H can be used to form a hydraulic drop for any of the previously described adjustable physical structures 12A-12G. The height of the expandable invert physical structure 12H (FIG. 8B) can be selected on the basis of the desired hydraulic drop with from 2 feet to 10 feet being representative. For example, as shown in FIG. 8B, the expandable invert physical structure 12H can be placed on the invert 26B of the channel 14-1 or 14-2 upstream of the adjustable through-flow physical structure 12B in place of the crest 20B (FIG. 3A) and ramp 22B (FIG. 3A) to form hydraulic formations 46B. As another example, the expandable invert physical structure 12H can be used with the adjustable outlet physical structure 12G (FIG. 7B) in place of the adjustable ramp 86G (FIG. 7B).

Figure 9:
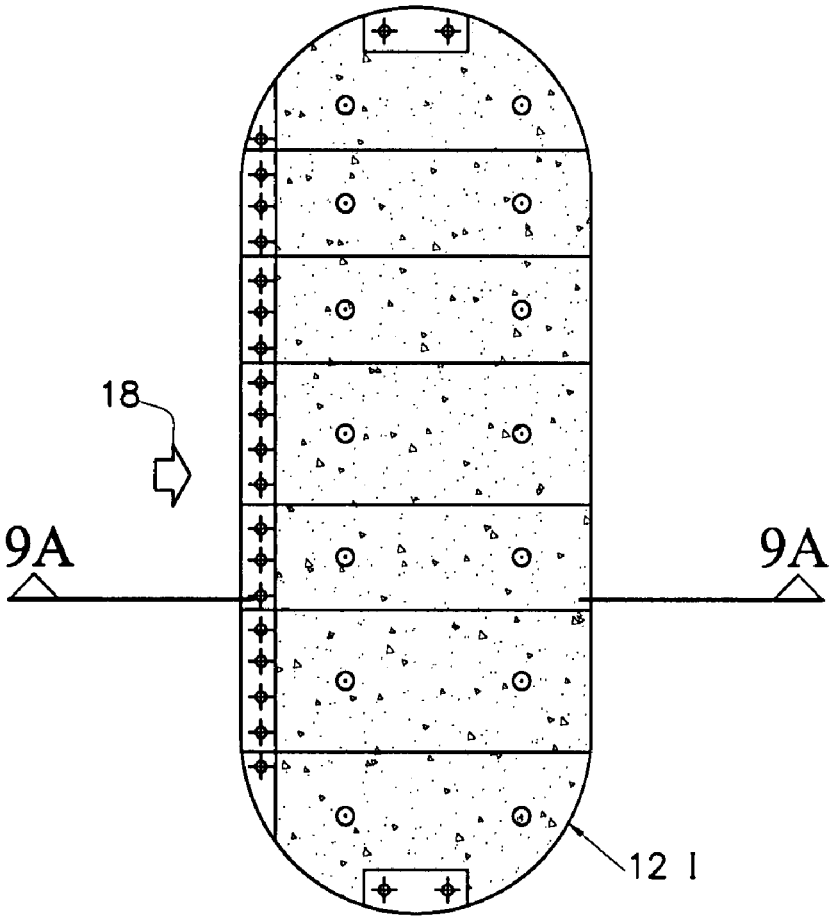
FIG. 9 is a plan view of an adjustable invert physical structure taken along line 9 of FIGS. 1A and 1B.
Figure 9A:
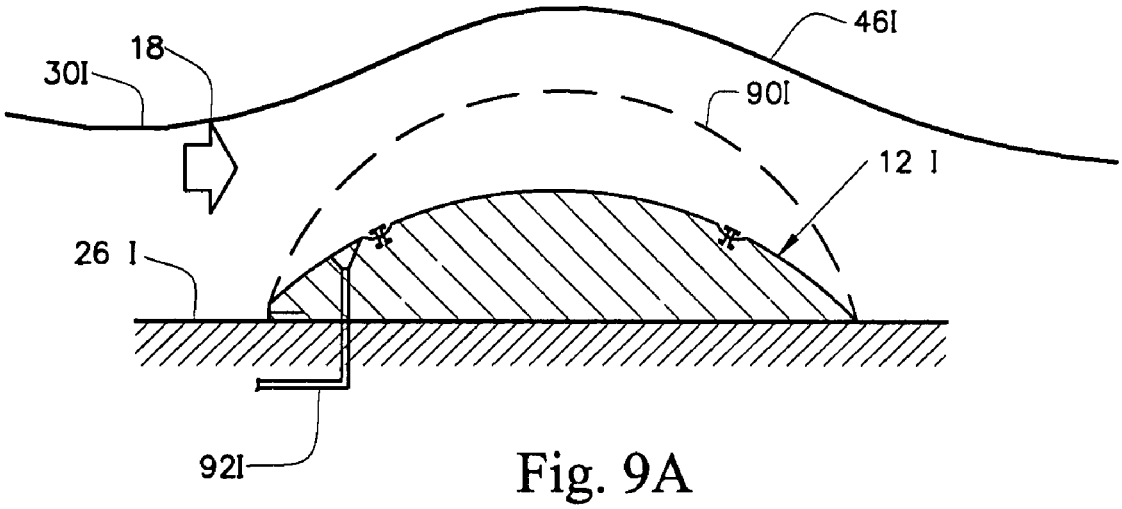
FIG. 9A is a cross sectional view taken along section line 9A-9A of FIG. 9.

Referring to FIGS. 9 and 9A, a moveable invert physical structure 12I is illustrated. The moveable invert physical structure 12I is configured for placement on the invert 261 of the channel 14-1 (FIG. 1A) or 14-2 (FIG. 1B). Because of it's size the moveable invert physical structure 12I can be easily moved and placed at a desired location on the system 10-1 (FIG. 1A) or 10-2 (FIG. 1B). The moveable invert physical structure 12I comprises a reinforced rubber membrane that is inflated with either air or water. As shown in FIG. 9A, the moveable invert physical structure 12I can expand and rise according to a predetermined shape as controlled by the internal reinforcing. In addition, multiple moveable invert physical structure 12I can be placed in series and adjusted to create optimal hydraulic formations such as waves, holes and eddies. Further, the spacing between the moveable invert physical structure 12I can be adjusted to take advantage of the natural wavelength and to enhance the size and the formation of a wave train.

As shown in FIG. 9, individual moveable invert physical structure 12I can be made as a single element or divided into individual segments. In FIG. 9A, the cross sectional geometry of the moveable invert physical structure 12I is semi-circular comprising between ⅛ to ½ of the circumference of a full circle. The diameter of the circular cross section is typically between 2 to 10 feet. Other curve-linear and triangular cross sections can provide similar results, but the semicircular section is the easiest and least expensive to make.

EXAMPLES

The described adjustable physical structures 12A-12I have undergone extensive experimentation and testing. Experimentation included hydraulic Froude scale modeling at 1:12 scale in Woodstock Md. Over 20 configurations were tested and four configurations were selected for further testing and development.

Hydraulic Froude scale modeling at a 1:12 scale, was conducted at a hydraulics laboratory at Colorado State University in Fort Collins Colo.

Testing and observation of six full scale prototypes built in McHenry, Md. was also conducted by the inventor. Survey data was taken and wave formations were documented. A second series of testing and observations was also conducted by the inventor. This testing included collecting formalized input from over 60 tip athletes and testing by the inventor.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

What is claimed is:

1. A physical structure for forming a hydraulic formation in a channel containing a flow of water comprising:

a control section in the channel configured to focus and build up the flow of water to a supercritical flow for forming a hydraulic jump; and an adjustable lip downstream of the control section configured for placement at a selected position in the flow of water to vary a velocity of the supercritical flow and form the hydraulic formation in a downstream pool with a subcritical flow.

2. The physical structure of claim 1 further comprising an adjustable placement mechanism configured to place the adjustable lip at the selected position.

3. The physical structure of claim 1 wherein the control section comprises a crest and a ramp.

4. The physical structure of claim 1 wherein the adjustable lip includes a plurality of vanes or perforations.

5. A physical structure for forming a hydraulic formation in a channel containing a flow of water comprising:

a control section in the channel configured to focus and build up the flow of water to form a hydraulic drop; and an adjustable lip downstream of the control section configured for placement at a selected position in the flow of water for varying an angle and a velocity of the flow of water to form the hydraulic formation, the adjustable lip comprising vanes or perforations configured to allow the flow of water to flow through the adjustable lip.

6. A physical structure for forming a hydraulic formation in a channel containing a flow of water comprising:

a control section in the channel configured to focus and build up the flow of water to form a hydraulic drop;

an adjustable lip downstream of the control section configured for placement at a selected position in the flow of water for varying an angle and a velocity of the flow of water to form the hydraulic formation; and an adjustable wing wall configured to control flow from a downstream pool into the flow of water over the control section and the adjustable lip, and to adjust a width of the channel proximate to the control section and the adjustable lip.

7. A physical structure for forming a hydraulic formation in a channel containing a flow of water comprising:

a control section in the channel configured to focus and build up the flow of water to form a hydraulic drop; and an adjustable lip downstream of the control section configured for placement at a selected position in the flow of water for varying an angle and a velocity of the flow of water to form the hydraulic formation, the adjustable lip comprising a plurality of lip blocks configured for selective placement to achieve the selected position.

8. A physical structure for forming a hydraulic formation in a channel containing a flow of water comprising:

a control section in the channel configured to focus and build up the flow of water to form a hydraulic drop, the control section comprising an adjustable crest and an adjustable ramp;

an adjustable lip downstream of the control section configured for placement at a selected position in the flow of water for varying an angle and a velocity of the flow of water to form the hydraulic formation.

9. A physical structure for forming a hydraulic formation in a channel containing a flow of water comprising:

a control section in the channel configured to focus and build up the flow of water to form a hydraulic drop; and an adjustable lip downstream of the control section configured for placement at a selected position in the flow of water for varying an angle and a velocity of the flow of water to form the hydraulic formation, wherein the control section or the adjustable lip comprises an inflatable element having a predetermined shape.

10. A physical structure for forming a hydraulic formation in a channel containing a flow of water comprising:

a crest in the channel configured to back up the flow of water and produce a hydraulic drop;

a ramp downstream of the crest having a sloped surface configured to vary a velocity and energy of the flow of water, the crest and the ramp comprising an adjustable mechanism configured for placement in a variety of positions;

an adjustable lip configured to receive the flow of water from the ramp and to vary an angle and the velocity of the flow of water to form the hydraulic formation; and a placement mechanism configured to place the adjustable lip at a selected position in the flow of water.

11. The physical structure of claim 10 wherein the placement mechanism comprises an element selected from the group consisting of inflatable bladders, hydraulic cylinders, and mechanical jacks.

12. A physical structure for forming a hydraulic formation in a channel containing a flow of water comprising:

a crest in the channel configured to back up the flow of water and produce a hydraulic drop;

a ramp downstream of the crest having a sloped surface configured to vary a velocity and energy of the flow of water;

an adjustable lip configured to receive the flow of water from the ramp and to vary an angle and the velocity of the flow of water to form the hydraulic formation;

a placement mechanism configured to place the adjustable lip at a selected position in the flow of water; and an adjustable wing wall comprising a plate configured for placement in the flow of water to control flow from a downstream pool into the flow over the control section and the adjustable lip, and to adjust a width of the channel proximate to the physical structure.

13. The physical structure of claim 12 wherein the flow of water has a supercritical flow exiting the ramp transitioning to a subcritical flow exiting the adjustable lip.

14. The physical structure of claim 12 wherein the crest and the ramp comprise an adjustable mechanism configured for placement in a variety of positions.

15. The physical structure of claim 12 wherein the crest and the ramp are contained in the outlet of a conveyance structure in flow communication with a pump or other source configured to supply the flow of water.

16. The physical structure of claim 12 wherein the crest and the ramp comprise portions of a base of the physical structure.

17. A physical structure for forming a hydraulic formation in a channel containing a flow of water comprising:

a crest in the channel configured to back up the flow of water and produce a hydraulic drop;

a ramp downstream of the crest having a sloped surface configured to vary a velocity and energy of the flow of water;

an adjustable lip configured to receive the flow of water from the ramp and to vary an angle and the velocity of the flow of water to form the hydraulic formation, the adjustable lip comprising a shaped wave shaper extension having a shape selected from the group consisting of a bell and a paddle of a selected height and width and adjustable slope; and a placement mechanism configured to place the adjustable lip at a selected position in the flow of water.

18. A physical structure for forming a hydraulic formation in a channel containing a flow of water comprising:

a crest in the channel configured to back up the flow of water and produce a hydraulic drop;

a ramp downstream of the crest having a sloped surface configured to vary a velocity and energy of the flow of water;

an adjustable lip configured to receive the flow of water from the ramp and to vary an angle and the velocity of the flow of water to form the hydraulic formation, the adjustable lip comprising a plate having a plurality of vanes or orifices configured to allow the flow of water to flow through the adjustable lip.

19. A physical structure for forming a hydraulic formation in a channel containing a flow of water comprising:

a crest in the channel configured to back up the flow of water and produce a hydraulic drop;

a ramp downstream of the crest having a sloped surface configured to vary a velocity and energy of the flow of water;

an adjustable lip configured to receive the flow of water from the ramp and to vary an angle and the velocity of the flow of water to form the hydraulic formation;

a placement mechanism configured to place the adjustable lip at a selected position in the flow of water; and an inflatable invert element upstream of the crest placed on an invert of the channel and configured to form a second hydraulic formation.

20. A physical structure for forming a hydraulic formation in a channel containing a flow of water comprising:

a base;

an adjustable crest comprising a first plate pivotably attached to the base configured to back up the flow of water and produce a hydraulic drop;

an adjustable ramp comprising a second plate attached to the crest having a sloped surface configured to vary a velocity and energy of the flow of water;

a placement mechanism configured to place the crest and the ramp in different positions; and an adjustable lip for receiving the flow of water from the ramp configured for placement in a selected position in the flow of water to vary an angle and the velocity of the flow of water to form the hydraulic formation.

21. The physical structure of claim 20 further comprising a second placement mechanism configured to place the adjustable lip in the selected position.

22. The physical structure of claim 20 wherein the placement mechanism comprises a track slide mount attached to the adjustable ramp.

23. A physical structure for forming a hydraulic formation comprising:

a conduit containing a flow of water;

a crest in flow communication with the conduit configured to back up the flow of water and produce a hydraulic drop;

a ramp downstream of the crest having a sloped surface configured to vary the velocity and energy of the flow of water;

an adjustable lip configured to receive the flow of water from the ramp and to vary an angle and the velocity of the flow of water to form the hydraulic formation;

a first placement mechanism configured to place the adjustable lip at a selected position in the flow of water; and a second placement mechanism configured to place the crest and the ramp in different positions;

the ramp comprising an adjustable mechanism attached to the second placement mechanism.

24. The physical structure of claim 23 further comprising an inflatable invert element upstream of the crest placed on an invert of the channel and configured to form a second hydraulic formation.

25. A system comprising:

a channel containing a flow of water;

at least one adjustable physical structure in the channel configured to form a hydraulic jump and accelerate the flow of water to a supercritical flow for forming at least one hydraulic formation, the adjustable physical structure comprising:

an adjustable lip configured to receive the supercritical flow and to vary a velocity of the supercritical flow to form the hydraulic formation in a downstream pool with a subcritical flow; and a placement mechanism configured to place the adjustable lip at a selected position.

26. The system of claim 25 wherein the adjustable lip comprises a plurality of vanes or perforations.

* * * * *